US011318534B2

(12) United States Patent
Furusawa et al.

(10) Patent No.: US 11,318,534 B2
(45) Date of Patent: May 3, 2022

(54) METAL MICROPARTICLE PRODUCTION METHOD AND METAL MICROPARTICLE PRODUCTION DEVICE

(71) Applicant: Panasonic Intellectual Property Management Co., Ltd., Osaka (JP)

(72) Inventors: Akio Furusawa, Osaka (JP); Kiyohiro Hine, Osaka (JP); Shinji Ishitani, Hyogo (JP); Misato Takahashi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 242 days.

(21) Appl. No.: 16/595,445

(22) Filed: Oct. 7, 2019

(65) Prior Publication Data

US 2020/0130064 A1 Apr. 30, 2020

(30) Foreign Application Priority Data

Oct. 26, 2018 (JP) ..... JP2018-201698
Dec. 5, 2018 (JP) ..... JP2018-228096
(Continued)

(51) Int. Cl.
*B22F 9/04* (2006.01)
*B22F 9/08* (2006.01)

(52) U.S. Cl.
CPC ..... *B22F 9/08* (2013.01); *B22F 9/04* (2013.01); *B22F 2009/0804* (2013.01); *B22F 2009/0836* (2013.01); *B22F 2009/0848* (2013.01)

(58) Field of Classification Search
None
See application file for complete search history.

(56) References Cited

U.S. PATENT DOCUMENTS 4,671,906 A 6/1987 Yasue et al.
5,917,113 A 6/1999 Suzuki
(Continued)

FOREIGN PATENT DOCUMENTS

JP 61-221310 10/1986
JP 7-179912 7/1995
(Continued)

*Primary Examiner* — George Wyszomierski
(74) *Attorney, Agent, or Firm* — Wenderoth, Lind & Ponack, L.L.P.

(57) ABSTRACT

To provide a method for efficiently producing metal microparticles having a particle diameter of 1 μm to 10 μm, and a device for producing the same. A metal microparticle production method is used, which includes a particle generating step of generating primary particles by irradiating a metal lump in a solvent in a first tank with an ultrasonic wave, and a particle splitting step of irradiating the primary particles with an ultrasonic wave in a solvent in a second tank and splitting the primary particles to produce secondary particles. Further, a metal microparticle production device is used, which includes: a first tank that has a solvent and a metal lump; a first heating unit that heats the solvent in the first tank; a first ultrasonic vibrator that is disposed in the first tank and irradiates the metal lump with an ultrasonic wave to generate primary particles; a second tank that has the solvent and the primary particles; and a second ultrasonic vibrator that irradiates the primary particles with an ultrasonic wave to split the primary particles.

7 Claims, 16 Drawing Sheets

(30) Foreign Application Priority Data

Dec. 5, 2018 (JP) ..... JP2018-228098
Dec. 5, 2018 (JP) ..... JP2018-228100

(56) References Cited

U.S. PATENT DOCUMENTS

| | | | | |
|---|---|---|---|---|
| 6,138,698 | A | 10/2000 | Tanaka et al. | |
| 6,391,067 | B2 | 5/2002 | Yanagita et al. | |
| 6,923,842 | B2 | 8/2005 | Furuya | |
| 7,392,814 | B2 | 7/2008 | Hasegawa et al. | |
| 8,828,276 | B2 | 9/2014 | Hotta | |
| 9,925,590 | B2 | 3/2018 | Čelko et al. | |
| 2003/0177865 | A1 | 9/2003 | Ono et al. | |
| 2008/0102019 | A1* | 5/2008 | Jeong | B82Y 30/00 423/447.1 |
| 2010/0003158 | A1* | 1/2010 | Ando | B30B 11/022 419/66 |
| 2018/0056448 | A1 | 3/2018 | Hayashi et al. | |
| 2020/0308671 | A1* | 10/2020 | Zeng | B22F 1/0003 |

FOREIGN PATENT DOCUMENTS

| | | |
|---|---|---|
| JP | 9-049007 | 2/1997 |
| JP | 10-229066 | 8/1998 |
| JP | 11-092804 | 4/1999 |
| JP | 11-154657 | 6/1999 |
| JP | 2003-268418 | 9/2003 |
| JP | 3511082 B | 3/2004 |
| JP | 2006-179764 | 7/2006 |
| JP | 3809714 B | 8/2006 |
| JP | 2008-142681 | 6/2008 |
| JP | 2011-089156 | 5/2011 |
| JP | 2012-082502 | 4/2012 |
| JP | 2013-012693 | 1/2013 |
| JP | 2015-534603 | 12/2015 |
| JP | 2017-150005 | 8/2017 |
| WO | 2001/081033 | 11/2001 |
| WO | 2016/158693 | 10/2016 |

* cited by examiner

METAL MICROPARTICLE PRODUCTION METHOD AND METAL MICROPARTICLE PRODUCTION DEVICE

TECHNICAL FIELD

The technical field relates to a method for producing a metal microparticle in a solder paste or the like used mainly for soldering an electronic circuit substrate, and a device for producing the same. In particular, the present disclosure relates to a method for producing a spherical solder particle having a particle diameter of 10 μm or less, and a device for producing the same.

BACKGROUND

In recent years, in order to cope with the densification of an electronic circuit substrate accompanying further miniaturization of electronic components, metal particles having a particle diameter of 10 μm to 25 μm have been put into practical use. Metal particles having a particle diameter of 10 μm or less are also required in the future. In the related art, as a metal particle production method, a centrifugal atomization method, a centrifugal atomization method in combination with use of gas atomization, a dispersion method using ultrasonic vibration, and a dispersion method using ultrasonic cavitation are known.

In the centrifugal atomization method, a molten metal material is dropped onto a disk, which rotates at a high speed, provided in a chamber, and droplets thereof are scattered due to the centrifugal force to produce spherical particles. At this time, the rotating disk is rotated at 25,000 rpm to 100,000 rpm. Since a thickness of a molten metal film on the disk decreases as the rotational speed of the disk increases, particles having smaller particle diameters can be produced. However, it is difficult to make an average diameter of the particles that can be produced smaller than 20 μm due to the restriction of a motor rotational speed (Patent Literature 1: JP-A-H7-179912).

In the centrifugal atomization method in combination with use of gas atomization, metal particles having a smaller particle diameter are produced by using the centrifugal atomization method described above. In this method, droplets of several tens of μm to several hundreds of μm are atomized and blown onto a disk, which rotates at a high speed, provided in a chamber, and a molten metal film on the rotating disk is thinned and scattered due to the centrifugal force to produce spherical particles. With this method, particles having a particle diameter close to 10 μm can be produced. However, a mass ratio of metal particles having a particle diameter of 10 μm or less to the produced particles is as low as about 3% (Patent Literature 2: JP-A-H11-92804).

Meanwhile, in the dispersion method using ultrasonic vibration, a metal lump is put into a high-temperature heating solvent kept at a temperature equal to or higher than a melting point of the metal lump, and under mechanical stirring, ultrasonic energy is applied thereto. By dispersing the molten metal lump as fine droplets and then cooling and solidifying the fine droplets, the metal particles can be produced. However, an average particle diameter of the particles that can be produced with this method is 11 μm to 98 μm, and it is difficult to produce metal particles having a particle diameter of 10 μm or less (Patent Literature 3: JP-A-H9-49007).

In the dispersion method using ultrasonic cavitation, a metal lump is put into a high-temperature heating solvent kept at a temperature equal to or higher than a melting point of the metal lump, and the metal lump is irradiated with ultrasonic waves without mechanical stirring. Cavitation occurs due to the ultrasonic wave irradiation, and the molten metal lump is dispersed as fine droplets by using a shock wave 110 during cavitation collapse. According to this method, metal particles can be produced, with a mass ratio of metal particle having a particle diameter of 1 μm to 6 μm to all metal particles being 50% to 80% (Patent Literature 4: JP-A-2017-150005).

SUMMARY

However, in the dispersion method using ultrasonic cavitation in the related art, the ultrasonic wave irradiation must be performed for 30 minutes or longer in order to obtain fine particles. In addition, since a generation rate of the particles is lowered as the ultrasonic wave irradiation time increases, the productivity may decrease.

The disclosure is made to solve the problems in the related art. An object of the disclosure is to provide a method for efficiently producing metal microparticles having a particle diameter of 1 μm to 10 μm, and a device for producing the same.

In order to achieve the above object, a metal microparticle production method is used, which includes: a particle generating step of generating primary particles by irradiating a metal lump in a solvent in a first tank with an ultrasonic wave; and a particle splitting step of irradiating the primary particles with an ultrasonic wave in a solvent in a second tank and splitting the primary particles to produce secondary particles.

A metal particle production method is used, which includes: a particle generating step of generating primary particles by irradiating a metal lump in a solvent in a first tank with an ultrasonic wave; a particle aggregating step of aggregating the primary particles to generate tertiary particles larger than the primary particles in a solvent in a second tank; a particle classifying step of classifying the primary particles and the tertiary particles by applying a magnetic field to a flow of a solvent containing the primary particles and the tertiary particles; and a particle recovering step of recovering the primary particles and the tertiary particles respectively that are classified.

A metal microparticle production device is used, which includes: a first tank that has a solvent and a metal lump; a first heating unit that heats the solvent in the first tank; a first ultrasonic vibrator that is disposed in the first tank and irradiates the metal lump with an ultrasonic wave to generate primary particles; a second tank that has the solvent and the primary particles; and a second ultrasonic vibrator that irradiates the primary particles with an ultrasonic wave to split the primary particles.

A metal microparticle production device is used, which includes: a first tank that has a solvent and a metal lump; a first ultrasonic vibrator that is disposed in the first tank, and irradiates the metal lump with an ultrasonic wave to generate primary particles; a second tank that has the solvent and the primary particles; a second ultrasonic vibrator that is disposed in the second tank, irradiates the primary particles with an ultrasonic wave, and aggregates the primary particles to generate tertiary particles larger than the primary particles.

A metal particle production device is used, which includes: a first tank that has a first solvent and a metal lump; a first heating unit that heats the first solvent; a first ultrasonic vibrator that irradiates the metal lump with an ultrasonic wave to generate primary particles; and a propagation unit that is provided between the first ultrasonic vibrator and the first tank, and has an incidence surface on which the ultrasonic wave is incident, and a radiation surface through which the ultrasonic wave incident via a second solvent interposed between the first ultrasonic vibrator and the incidence surface is irradiated onto a first tank side.

According to the metal microparticle production method and the metal microparticle production device of the disclosure, metal microparticles having a particle diameter of 1 μm to 10 μm can be efficiently produced.

DESCRIPTION OF EMBODIMENTS

Hereinafter, embodiments of the disclosure will be described with reference to the drawings.

First Embodiment

<Primary Particle Production Process>

Figure 1:
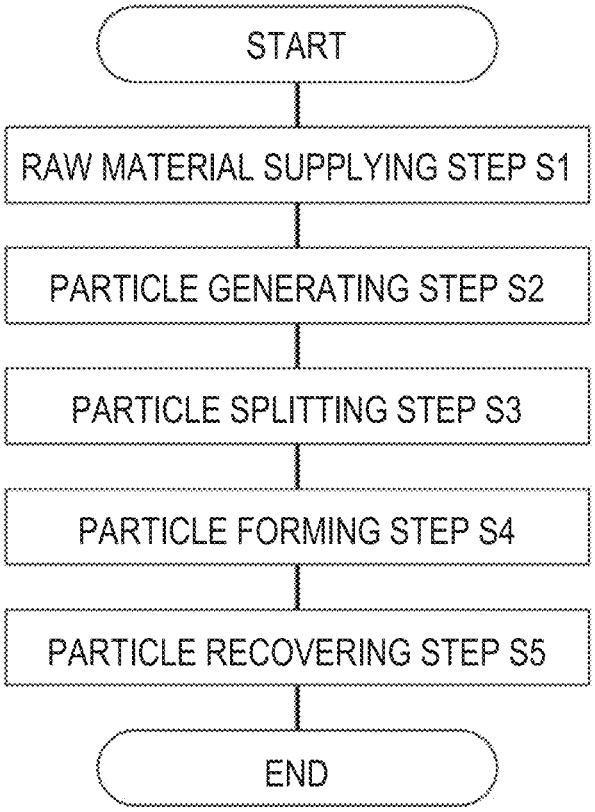
FIG. 1 is a diagram illustrating steps of a metal microparticle production method according to a first embodiment.

FIG. 1 is a diagram illustrating steps of a metal microparticle production method according to a first embodiment. The metal microparticle production method of the disclosure may include at least a particle generating step S2 and a particle splitting step S3. As shown in FIG. 1, in the present embodiment, a raw material supplying step S1, a particle forming step S4, a particle recovering step S5, and the like are preferably performed.

In the raw material supplying step S1, a metal lump is supplied as a raw material of metal microparticles, and a liquid-state metal lump, which is obtained by being heated to a temperature equal to or higher than a melting point thereof and being melted, is supplied into a solvent.

In the particle generating step S2, the liquid-state metal lump supplied into the solvent is irradiated with an ultrasonic wave to generate primary particles. In the particle generating step S2, a shock wave of cavitation is caused to act to generate droplet primary particles from a surface of the molten metal lump.

In the particle splitting step S3, the primary particles obtained in the particle generating step S2 are further irradiated with the ultrasonic wave, so as to be split. That is, the shock wave of cavitation is caused to act on the primary particles described above, and the primary particles are further split into fine droplet secondary particles, that is, metal microparticles. In the description, the particles obtained by performing the particle generating step S2 are referred to as primary particles, and the particles obtained by performing the particle splitting step S3 are referred to as secondary particles (metal microparticles).

Here, the particle splitting step S3 is performed on a mixture mainly containing the solvent and the primary particles. That is, the solvent and the primary particles, which are obtained in the particle generating step S2 described above, are moved to another place in a metal microparticle production device, or separately transferred to a different device, and are further irradiated with the ultrasonic wave.

As will be described below, it is preferable that the particle generating step S2 and the particle splitting step S3 are performed in one metal microparticle production device from the viewpoint of production efficiency of the secondary particles. The solvent used in the particle generating step S2 and the solvent used in the particle splitting step S3 may be the same or different. However, secondary particles 112 (see FIG. 2B) can be produced more efficiently when the solvents are the same.

In the particle forming step S4, the split secondary particles 112 are changed to a spherical shape due to surface tension, and thereafter cooled to a temperature below the melting point of the metal to form a solid.

In the particle recovering step S5, the produced secondary particles 112 are separated from the solvent and recovered.

Hereinafter, the particle generating step S2 and the particle splitting step S3 will be mainly described.

<Formation Mechanism of Metal Microparticle (Secondary Particle)>

Figure 2A:
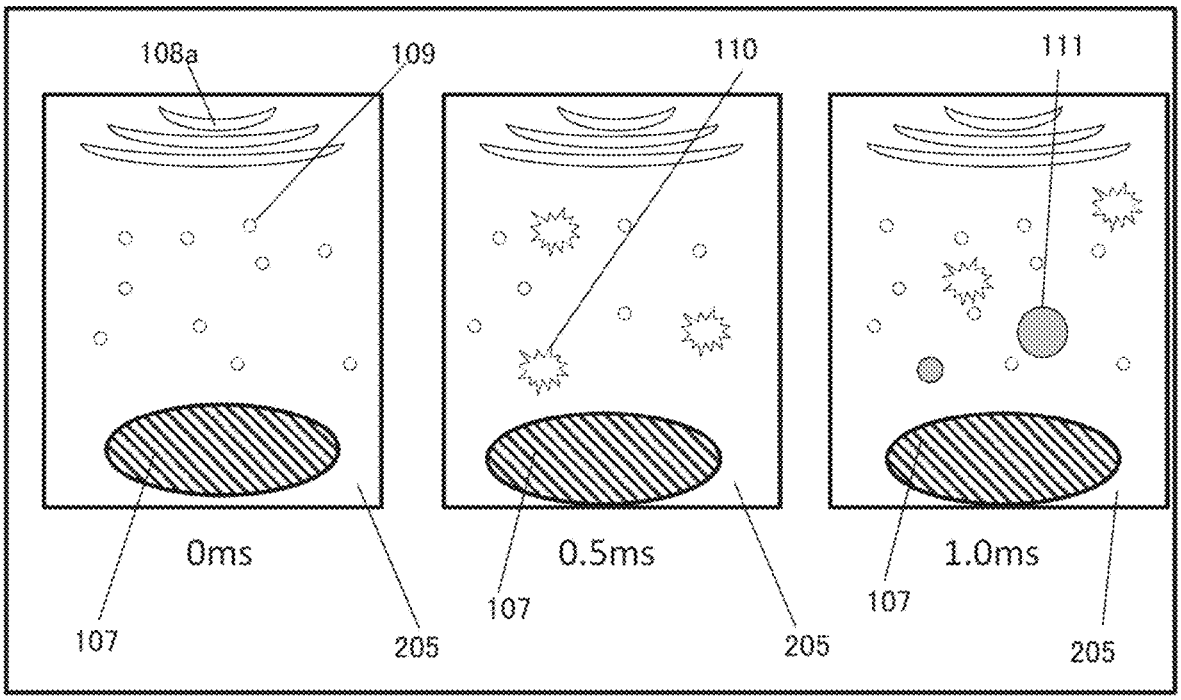
FIG. 2A is a diagram illustrating a process of generating droplets (primary particles) from a molten metal lump in the first embodiment.
Figure 2B:
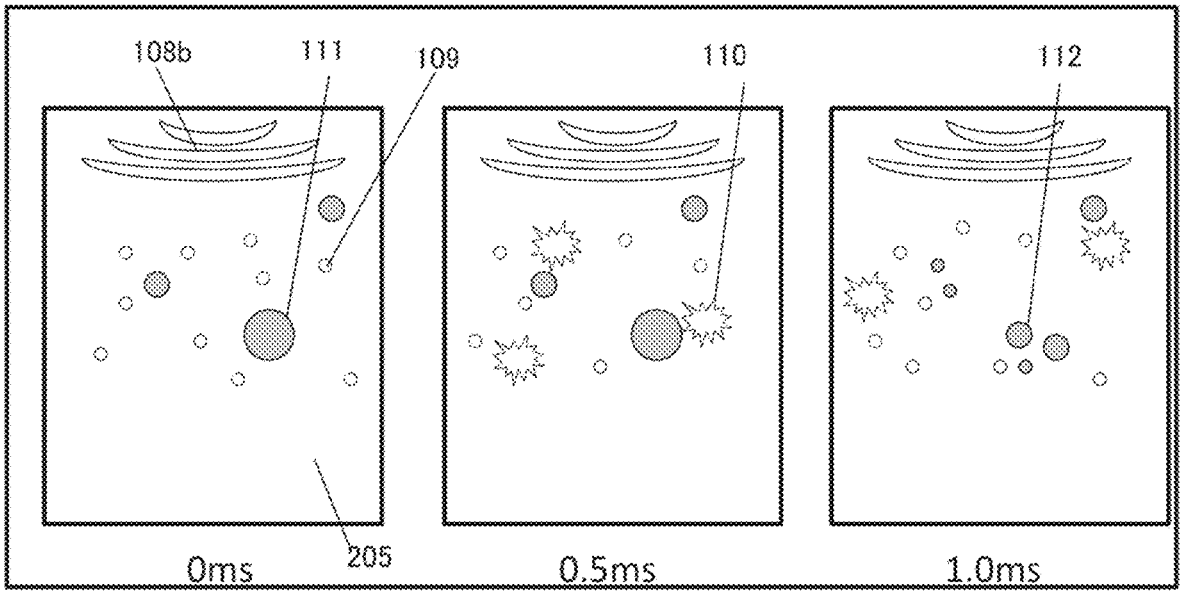
FIG. 2B is a diagram illustrating a process of splitting the generated droplets (primary particles) according to the first embodiment.

FIGS. 2A and 2B are diagrams illustrating processes of forming the secondary particles 112 from a metal lump 107. By observing the processes in detail at 10000 frames per second using a high-speed camera, a particle formation mechanism using ultrasonic wave irradiation can be clarified, which is unknown until now.

FIG. 2A is a diagram illustrating a temporal process of generating droplets, that is, primary particles 111, from the molten metal lump 107. This process is the particle generating step S2 in FIG. 1. When the liquid-state metal lump 107 obtained by heating and melting is supplied into a solvent 106, the metal lump 107 precipitates. Accordingly, the solvent 106 is an upper layer, and the metal lump 107 is a lower layer. The metal lump 107 is heated to a temperature equal to or higher than a melting point thereof so as to maintain a molten state even after being mixed with the solvent 106. That is, the solvent 106 is maintained at a high temperature. The solid-state metal lump 107 may be mixed with the solvent 106 and then the metal lump 107 may be heated to melt.

When irradiating the obtained mixture with an ultrasonic wave 108*a*, minute air bubbles 109 are generated in the solvent 106 due to a compressional wave (left in FIG. 2A). By repeating a loose state and a dense state, the air bubbles 109 repeat expansion and contraction to grow gradually. Further, when the greatly grown air bubbles 109 are unable to withstand the contraction, the air bubbles 109 are crushed and a high pressure shock wave 110 is generated (center in FIG. 2A). The shock wave 110 acts on a surface of the metal lump 107 to generate droplets, that is, the primary particles 111 (right in FIG. 2A).

Meanwhile, FIG. 2B is a diagram illustrating a temporal process of splitting the generated primary particles 111. This process is the particle splitting step S3 in FIG. 1. A large number of droplets (primary particles 111) suspend in the solvent 106 after the particle generating step S2 (left in FIG. 2B). When the high pressure shock wave 110 generated at the time of crushing the air bubbles 109 using an ultrasonic wave 108*b* acts on the primary particles 111 (center in FIG. 2B), the primary particles 111 are split to generate the fine secondary particles 112 (right in FIG. 2B).

<Particle Generating Step S2>

The method of emitting the ultrasonic wave 108*a* in the particle generating step S2 is not particularly limited, and a general ultrasonic vibrator can be used to emit the ultrasonic wave. The ultrasonic vibrator may be any one of a horn type and a throw-in type. It is preferable that the ultrasonic wave is emitted from a solvent 106 side because an intensity of cavitation is easily increased, and it is more preferable that the ultrasonic vibrator is a horn type.

<Ultrasonic Wave Frequency>

Figure 3:
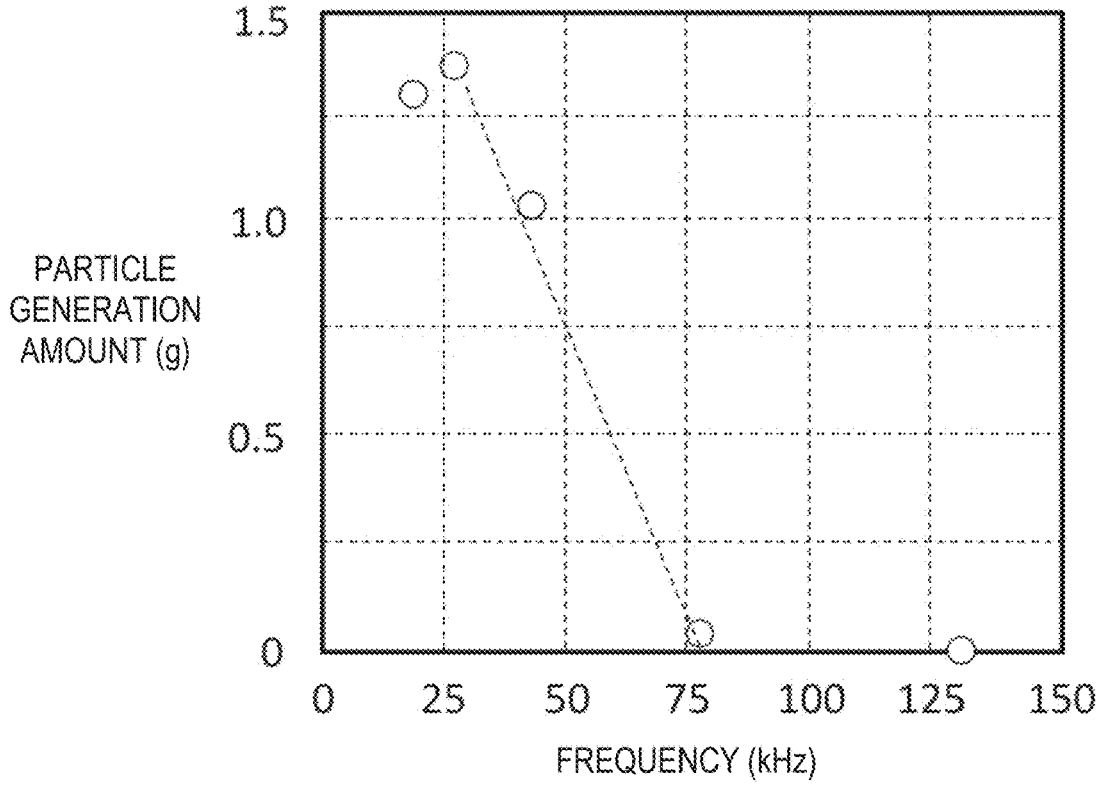
FIG. 3 is a diagram illustrating a relationship between a particle generation amount and an ultrasonic wave frequency according to the first embodiment.

A frequency of the ultrasonic wave 108*a* for irradiation in the particle generating step S2 will be described. FIG. 3 is a diagram illustrating a relationship between an ultrasonic wave frequency and a generation amount of the primary particles 111 when the metal lump 107 positioned in a lower part in the solvent 106 is irradiated for 15 seconds with an ultrasonic wave of 450 W. In FIG. 3, the generation amount of the primary particles 111 is a difference between the mass of the metal lump 107 supplied to the solvent 106 before the ultrasonic wave irradiation and the mass of the metal lump 107 remaining without turning into the primary particles 111 after the ultrasonic wave irradiation. The mass is measured with a precision balance that is capable of measuring to 0.0001 g.

As shown in FIG. 3, when the frequency is 26 kHz, the generation amount of the primary particles 111 is the largest, and when the frequency is changed toward a low frequency side, the generation amount of the primary particles 111 slightly decreases. When the frequency is changed toward a high frequency side, the generation amount of the primary particles 111 rapidly decreases. Thus, it is particularly preferable that the ultrasonic wave frequency is 26 kHz. When the frequency is increased, the generation amount of the primary particles 111 decreases. Since the generation amount of the primary particles 111 when the frequency is 50 kHz is about ½ of the generation amount of the primary particles 111 when the frequency is 26 kHz in comparison, it is desired that an upper limit of the frequency is 50 kHz. Further, since the ultrasonic wave becomes audible and louder when the frequency is lowered, it is desired that a lower limit thereof is 20 kHz. As a result, a range of 20 kHz to 50 kHz is preferable.

<Ultrasonic Wave Output>

When an output of the ultrasonic wave for irradiation in the particle generating step S2 is changed, the magnitude of the amplitude of a vibration wave changes. Therefore, an effect of growing the air bubbles is strong, and the shock wave 110 during air bubble collapse is large.

Figure 4:
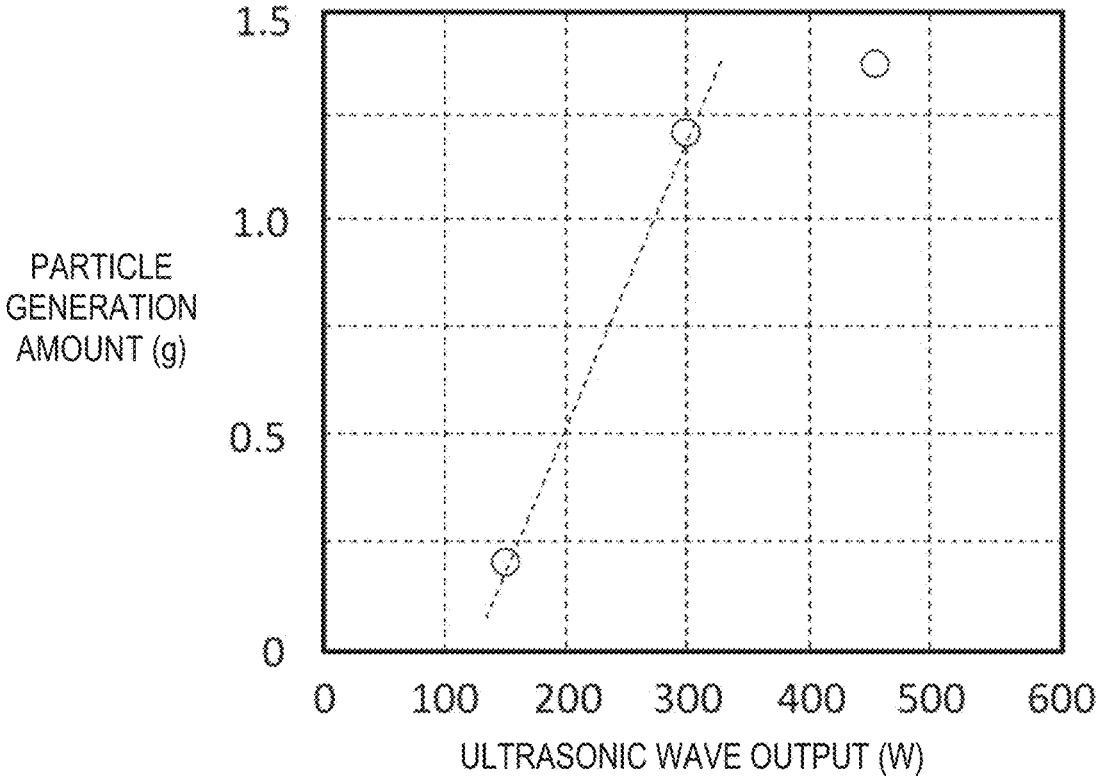
FIG. 4 is a diagram illustrating a relationship between an ultrasonic wave output and a primary particle generation amount according to the first embodiment.

FIG. 4 is a diagram illustrating a relationship between the ultrasonic wave output and the generation amount of the primary particles 111 when the metal lump 107 positioned in the lower part in the solvent 106 is irradiated for 15 seconds with an ultrasonic wave having the frequency of 26 kHz. In FIG. 4, the generation amount of the primary particles is a difference between the mass of the metal lump 107 supplied to the solvent before the ultrasonic wave irradiation and the mass of the metal lump 107 remaining without turning into the primary particle 111 after the ultrasonic wave irradiation. The mass is measured with a precision balance that is capable of measuring to 0.0001 g.

As shown in FIG. 4, when the ultrasonic wave output is 150 W, the generation amount of the primary particles 111 is small, and when the ultrasonic wave output is 300 W or more, the generation amount of the primary particles 111 increases. Thus, it is particularly preferable that the ultrasonic wave output is 300 W or more. When the ultrasonic wave output is lowered, the generation amount of the primary particles 111 decreases. Since the generation amount of the primary particles 111 when the ultrasonic wave output is 220 W is about ½ of the generation amount of the primary particles 111 when the ultrasonic wave output is 300 W in comparison, it is desired that a lower limit of the ultrasonic wave output is 220 W. Further, since cost of an ultrasonic vibration device rapidly increases when the ultrasonic wave output is increased, it is desired that an upper limit thereof is 1200 W.

<Ultrasonic Wave Irradiation Time>

Table 1 below shows a relationship between an average particle diameter of the primary particles 111 that can be obtained and an ultrasonic wave irradiation time when the metal lump 107 is irradiated with an ultrasonic wave having a frequency of 26 kHz and an output of 450 W. In Table 1, values of the average particle diameter are measured by a laser diffraction particle diameter measurement device.

TABLE 1

| Ultrasonic wave irradiation time | Average particle diameter |
|---|---|
| 30 s | 16 μm |
| 1 min | 12 μm |

TABLE 1-continued

| Ultrasonic wave irradiation time | Average particle diameter |
|---|---|
| 3 min | 9 μm |
| 5 min | 7 μm |
| 10 min | 6 μm |
| 30 min | 4 μm |
| 60 min | 3 μm |

As shown in Table 1, the average particle diameter is 16 μm when the ultrasonic wave irradiation time is 30 seconds, and tends to decrease as the irradiation time is lengthened. When the primary particles 111 are to be generated and the average particle diameter of the primary particles 111 is set to be 10 μm or less, the required irradiation time is about 3 minutes or longer.

Figure 5:
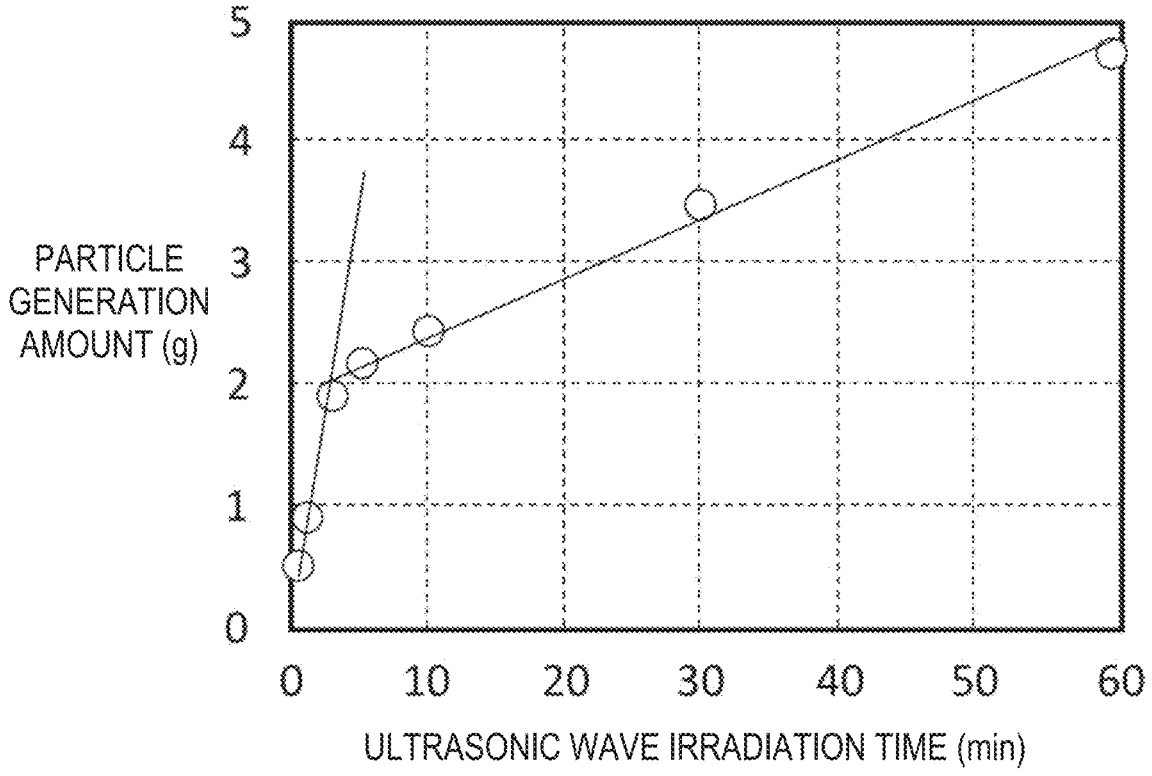
FIG. 5 is a diagram illustrating a relationship between an ultrasonic wave irradiation time and the primary particle generation amount according to the first embodiment.

FIG. 5 is a diagram illustrating a relationship between the generation amount of the primary particles 111 and the ultrasonic wave irradiation time when the metal lump 107 supplied to the solvent 106 is irradiated with the ultrasonic wave having a frequency of 26 kHz and an output of 450 W. In FIG. 5, the generation amount of the primary particles 111 is a difference between the mass of the metal lump 107 supplied to the solvent 106 before the ultrasonic wave irradiation and the mass of the metal lump 107 remaining without turning into the primary particles 111 after the ultrasonic wave irradiation. The mass is measured with a precision balance that is capable of measuring to 0.0001 g.

As shown in FIG. 5, the generation amount of the primary particles 111 increases rapidly when the ultrasonic wave irradiation time is 30 seconds to 3 minutes. However, when the ultrasonic wave irradiation time is 5 minutes or longer, a rate of increase in the generation amount of the primary particles 111 decreases. When the particle generation amount per hour from 30 seconds to 3 minutes is calculated, the particle generation amount per hour is calculated to be 1 g/min for 30 seconds, 0.9 g/min for 1 minute, and 0.65 g/min for 3 minutes.

Therefore, in order to efficiently generate the primary particles 111 in the particle generating step S2 in the present embodiment, it is desired to set the ultrasonic wave irradiation time between 30 seconds and 1 minute.

<Particle Splitting Step S3>

In the particle splitting step S3, the primary particles 111 obtained in the particle generating step S2, that is, the primary particles 111 dispersed in the solvent 106, are irradiated with the ultrasonic wave 108*b* and are split into the secondary particles 112. The ultrasonic wave irradiation method is not particularly limited. The ultrasonic wave 108*b* can be emitted using a general ultrasonic vibrator. At this time, the ultrasonic wave 108*b* may be emitted from any direction as long as the object and the effects of the present embodiment are not impaired, and it is preferable that the ultrasonic wave 108*b* is emitted from a direction in which attenuation of the ultrasonic wave is little. The ultrasonic vibrator for emitting the ultrasonic wave 108*b* may be a horn type or a throw-in type.

<Ultrasonic Wave Irradiation Conditions>

Irradiation conditions of the ultrasonic wave 108*b* for irradiation in the particle splitting step S3 are not particularly limited as long as the object and effects of the present embodiment are not impaired. For example, the frequency can be set at 22 kHz to 130 kHz. In addition, the ultrasonic wave output can be set at 90 W to 1 kW. Further, it is desired that the ultrasonic wave irradiation time is set to be 15 seconds to 3 minutes.

As will be described below in a second embodiment, the particle splitting step S3 may be performed while the ultrasonic vibrator is moved relative to the solvent 106 and the primary particles 111. In this case, an average particle diameter of the secondary particles 112 that can be obtained can be changed by controlling a moving speed of the primary particles 111 with respect to the ultrasonic vibrator. A relationship between the moving speed (flow speed) and the average particle diameter will be described in detail in the second embodiment.

<Ultrasonic Wave Conditions of Particle Generating Step S2 and Particle Splitting Step S3>

Ultrasonic wave conditions of the particle generating step S2 and the particle splitting step S3 may be the same. In the particle generating step S2, it is preferable to make the cavitation stronger than that in the particle splitting step S3. Therefore, with respect to the condition of the particle generating step S2, conditions of a higher output and a lower frequency than those in the particle splitting step S3 are preferred.

When the ultrasonic wave is applied for a long period of time in the particle generating step S2, the generation rate of the primary particles 111 is lowered since a particle concentration increases. Therefore, the particle splitting step S3 is performed in another tank without the metal lump 107.

In addition, a temperature gradient may be provided between the start and the end of the particle splitting step S3. As will be described below in the second embodiment, when the particle splitting step S3 is performed while the solvent 106 and the primary particles 111 are moved in a predetermined direction, the temperature gradient can be provided by controlling a temperature of the solvent on an upstream side and a temperature of the solvent on a downstream side respectively.

As will be described below, when the particle splitting step S3 is performed in a circulation tank, it is preferable to measure the temperature in the circulation tank at a plurality of locations so as to control the temperature therein.

<Metal Lump 107>

The metal lump 107 serving as a raw material of the secondary particles 112 may be an alloy for solder paste for soldering an electronic circuit substrate or the like, and in the present embodiment, the metal lump 107 is Bi-45 mass % In.

However, the metal lump 107 (and thus the secondary particles 112) is not limited to Bi-45 mass % In, and may be a Bi—In alloy in which a mixing ratio of Bi and In is changed. At least one of metals selected from Sn, Ag, Cu, Sb, Bi, and In, or an alloy thereof can be used, not limited to a combination of Bi—In. In addition, metal oxides, which can be obtained from the metals or the alloy, may also be used.

Further, in the method of the present embodiment, the secondary particles 112 having a particle diameter of 1 μm to 10 μm can be efficiently produced, and submicron particles having a particle diameter of less than 1 μm can also be produced by lengthening the ultrasonic wave irradiation time in the particle splitting step S3. On the other hand, when the ultrasonic wave irradiation time is shortened in the particle splitting step S3, metal microparticles having a particle diameter of 10 μm or more can be produced.

<Solvent 106>

The solvent 106 used in the present embodiment is not particularly limited as long as the solvent 106 has a boiling point higher than the melting point of the metal lump 107 and does not react with the metal lump 107. For example, a solvent having a boiling point of about 200° C. to 500° C. can be used. Examples thereof include triethylene glycol monobutyl ether, diethylene glycol monohexyl ether, 2-ethyl-1,3-hexanediol, silicone oil, and corn oil. Alternatively, an ionic liquid having low volatility may be used.

<Effects>

According to such a configuration, in the particle generating step, the metal lump 107 as the raw material of the metal microparticles is irradiated with the ultrasonic wave 108*a*, and the shock wave 110 generated during cavitation collapse is caused to act thereon, so that the primary particles 111 are generated.

Then, in the particle splitting step S3 different from the particle generating step S2, the primary particles 111 are irradiated with the ultrasonic wave 108*b* to be split, so that metal microparticles having a particle diameter of 1 μm to 10 μm can be efficiently produced.

Further, when it is desired to reduce the particle diameter, the ultrasonic wave irradiation time is lengthened in the particle splitting step S3, so that the metal microparticles can be produced without lowering the particle generation amount.

That is, according to the metal microparticle production method of the disclosure, since the particle generating step S2 and the particle splitting step S3 are separate, the particle generation rate is not reduced in the production of the metal microparticles having a particle diameter of 1 μm to 10 μm.

Second Embodiment

A metal microparticle production device that is capable of performing the metal microparticle (secondary particles 112) production method according to the first embodiment will be described below. The matters not described are the same as those in the first embodiment.

<Device Structure>

Figure 6:
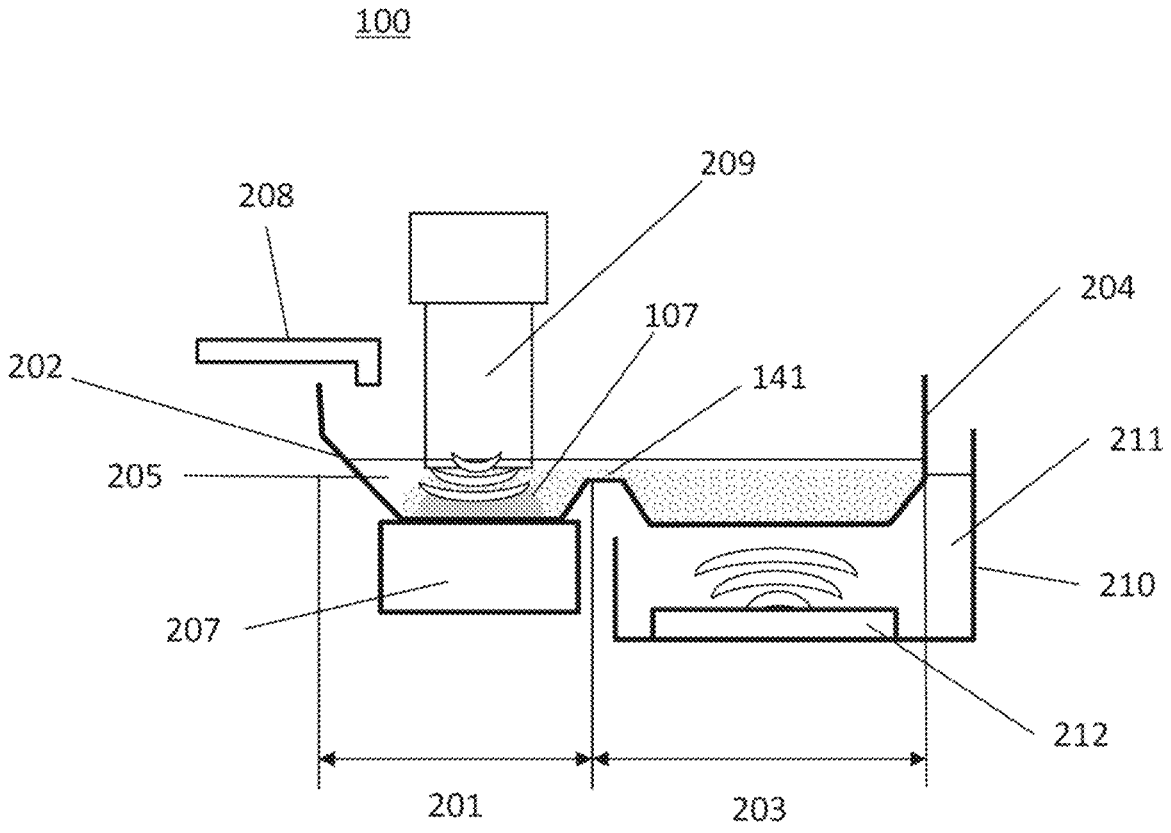
FIG. 6 is a schematic diagram illustrating a cross section of a metal microparticle production device according to a second embodiment.

FIG. 6 is a schematic diagram of a cross section of a metal particle production device 100 according to the second embodiment of the disclosure. A metal particle production device 100 according to the second embodiment may include at least a particle generating unit 201 that generates the primary particles 111 by irradiating the metal lump 107 serving as a raw material of metal microparticles with an ultrasonic wave, and a particle splitting unit 203 that splits the primary particles 111 by irradiating the generated primary particles with an ultrasonic wave to produce the secondary particles 112. The particle generating unit 201 and the particle splitting unit 203 are provided as separate configurations. With such a configuration, the secondary particles 112 can be produced while efficiently generating the primary particles 111.

A first tank 202 of the particle generating unit 201 and a second tank 204 of the particle splitting unit 203 are each filled with a first solvent 205 that has a boiling point equal to or higher than a melting point of the metal lump 107. The metal lump 107 serving as the raw material of the metal microparticles is further supplied to the first tank 202. Here, the metal lump 107 may be supplied in a molten state or may be supplied in a non-molten state. In the particle generating unit 201, the metal lump 107 and the first solvent 205 are heated to a temperature equal to or higher than the melting point of the metal lump 107 by using a first heating unit 207.

The first heating unit 207 may be disposed in the first tank 202, and a first ultrasonic vibrator 209 may be configured as a second ultrasonic vibrator 212 is configured.

The metal lump 107 can be additionally supplied from a raw material supply unit 208. The raw material supply unit 208 may supply only the metal lump 107, or may supply the metal lump 107 and the first solvent 205 separately or as a mixture.

The first ultrasonic vibrator 209 of a horn type is immersed in the first solvent 205 from an upper side, and ultrasonic cavitation can be caused to act on a surface of the metal lump 107 via the first solvent 205.

The first heating unit 207 is provided below the first tank 202, and heats the first solvent 205 to raise the temperature of the first solvent 205 to a temperature equal to or higher than the melting point of the metal lump 107.

On the other hand, the second ultrasonic vibrator 212 of a throw-in type, and a cooling tank 210 for cooling the second ultrasonic vibrator 212 are provided below the second tank 204 of the particle splitting unit 203. The cooling tank 210 is filled with a second solvent 211 that has a boiling point of 70° C. or higher.

The ultrasonic cavitation can be caused to act on the first solvent 205 in the second tank 204 via the second solvent 211 by the second ultrasonic vibrator 212 of a throw-in type which is disposed at the bottom of the cooling tank 210. The first solvent 205 is heated to a temperature equal to or higher than the melting point of the metal lump 107, while the second ultrasonic vibrator 212 of a throw-in type is maintained at a heat-resistant temperature of 60° C. or lower via the second solvent 211.

A partition 141 is provided between the first tank 202 and the second tank 204. The primary particles 111 and the first solvent 205 flow from the first tank 202 to the second tank 204 over the partition 141. The partition 141 may be a simple plate or a triangular prism shaped barrier. A surface of the first solvent 205 is above the partition 141.

Figure 7:
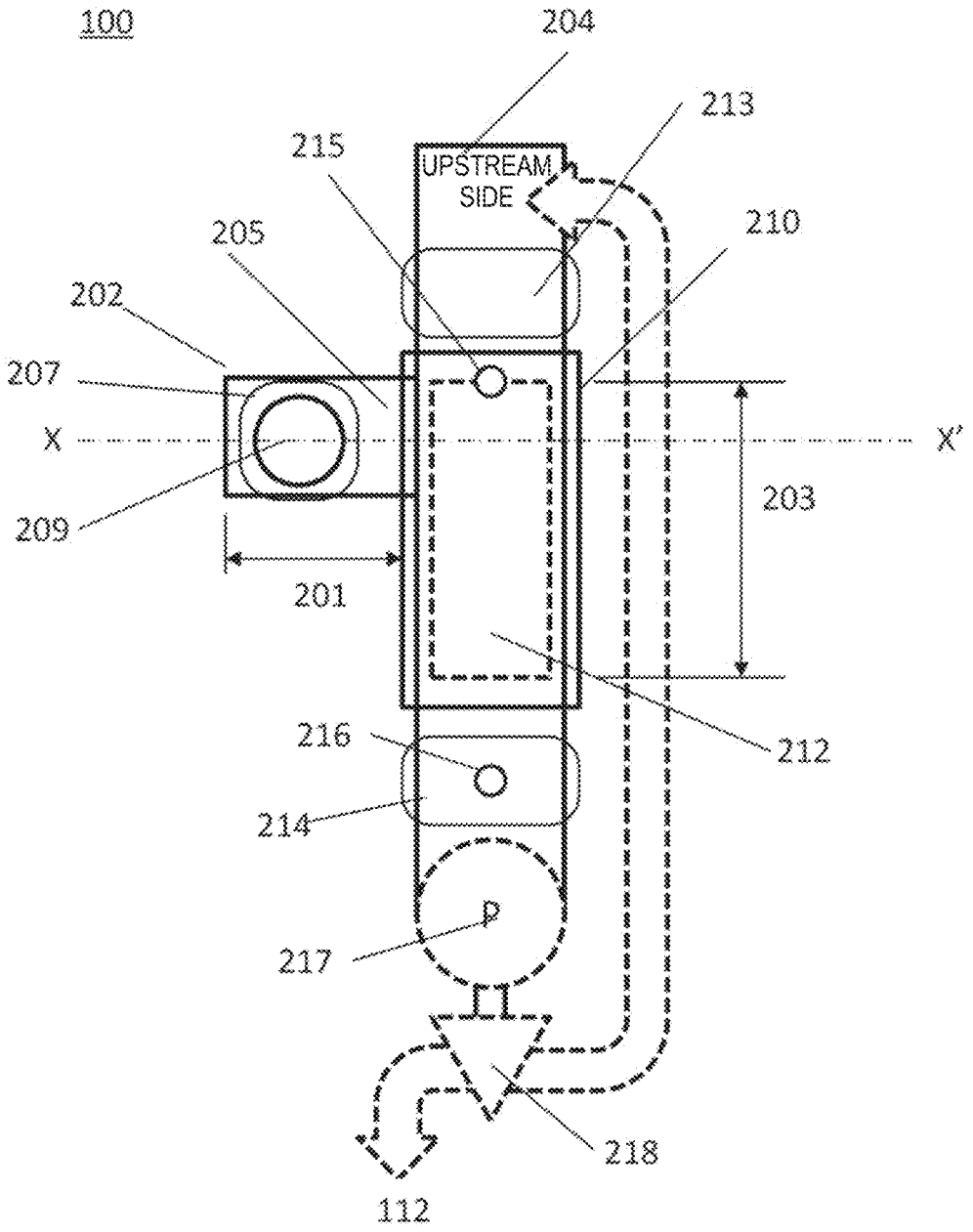
FIG. 7 is a schematic diagram illustrating the metal microparticle production device as viewed from above according to the second embodiment.

FIG. 7 is a schematic diagram of the metal microparticle production device as viewed from above according to the second embodiment. FIG. 6 is a cross section taken along a line X-X' in FIG. 7. As shown in FIGS. 6 and 7, the first tank 202 in the particle generating unit 201 and the second tank 204 in which the particle splitting unit 203 is disposed are connected such that the first solvent 205 and the primary particles 111 can flow from a first tank 202 side to a second tank 204 side. Then, by circulating the first solvent 205 at the second tank 204 side, the primary particles 111 produced in the particle generating unit 201 move toward the second tank 204 side. Hereinafter, the second tank 204 will be described in detail.

<Second Tank 204>

The second tank 204 that is connected to the first tank 202 is filled with the first solvent 205. A second heating unit 213 is disposed on an upstream side of the second tank 204, and a cooling device 214 is disposed on a downstream side of the second tank 204.

In the second tank 204, the following control is performed using the second heating unit 213 and the cooling device 214.

The temperature of the first solvent 205 in a first temperature measurement unit 215 disposed in the vicinity of the first tank 202 is controlled to be equal to or higher than the melting point of the metal lump 107. The temperature of the first solvent 205 in a second temperature measurement unit 216 disposed behind the second ultrasonic vibrator 212 is controlled to be lower than the melting point of the metal lump 107. That is, there is a temperature gradient in the first solvent 205 in the second tank 204. By controlling the temperature in this manner, the primary particles 111 can be easily and sufficiently split in the particle splitting unit 203, and the secondary particles 112 can be solidified at a cooling device 214 side to prevent bonding of the secondary particles 112.

As described above, the cooling tank 210 filled with the second solvent 211 for cooling the second ultrasonic vibrator 212 is provided below the particle splitting unit 203 of the second tank 204.

In addition, the second ultrasonic vibrator 212 is disposed at the bottom of the cooling tank 210. The first solvent 205 in the second tank 204 together with the secondary particles 112 is fed to a particle separating device 218 using a pump 217 capable of controlling a liquid feed amount.

Then, the secondary particles 112 and the first solvent 205 are separated, and only the first solvent 205 is returned to the upstream side of the second tank 204. By circulating the first solvent 205 in the second tank 204, the first solvent 205 can be reused, and a solvent waste amount can be reduced. Further, by controlling a circulation rate using the pump 217, a time during which the primary particles 111 accumulates in the particle splitting unit 203 can be changed. That is, the time for irradiating the primary particles 111 with the ultrasonic wave can be changed, and the secondary particles 112 having an arbitrary particle diameter distribution can be obtained.

Only one particle generating unit 201 is shown in FIG. 7. Alternatively, a plurality of particle generating units 201 may be provided in order to increase the generation amount of the primary particles 111. In the present embodiment, the first ultrasonic vibrator 209 is an ultrasonic vibrator of a horn type and the second ultrasonic vibrator 212 is an ultrasonic vibrator of a throw-in type, but the combination is arbitrary. For example, a combination of a horn type and a horn type may be used, or a combination of a throw-in type and a horn type may be used, or a combination of a throw-in type and a throw-in type may be used. The first heating unit 207 and the second heating unit 213 may also be provided in each tank.

<Particle Production Performance: Examples>

The secondary particles 112 were actually produced by using the metal particle production device 100 of the second embodiment of the disclosure, with the metal lump 107 being Bi-45 mass % In (liquid phase: 95° C., solid phase: 89° C.).

In Examples, triethylene glycol monobutyl ether (boiling point: 278° C.) was used as the first solvent 205, and tap water was used as the second solvent 211. An ultrasonic vibrator having a frequency of 20 kHz and a maximum output of 600 W and a horn tip end diameter of 50 mm was used as the first ultrasonic vibrator 209 of a horn type. An ultrasonic device having a frequency of 26 kHz and a maximum output of 500 W, a length of 500 mm and a width of 180 mm in a flow direction of the first solvent 205 in the second tank 204 was used as the second ultrasonic vibrator 212 of a throw-in type.

The first solvent 205 was heated to 110° C. by using the first heating unit 207 in the first tank 202. When a liquid temperature of the first solvent 205 reached 110° C., the metal lump 107 immersed in the first solvent 205 was melted and turned into a liquid state.

Here, when the first ultrasonic vibrator 209 of a horn type operates at 500 W, the cavitation occurs at the horn tip end portion. The shock wave 110 generated during the cavitation collapse acts on a surface of the molten metal lump 107 to obtain droplets (primary particles) of the metal lump 107. However, since the area of an interface, which is represented by the area of a surface of the primary particle 111× the number of the primary particles 111, increases when the number of the generated primary particles 111 is increased, the ultrasonic wave propagation is attenuated. Therefore, in order to efficiently generate the primary particles 111, it is important to make an adjustment such that the number of the primary particles 111 is not increased.

Therefore, in the production device of the present embodiment, the first solvent 205 in the second tank 204 is circulated using the pump 217. Accordingly, the first solvent 205 in the first tank 202 and the primary particles 111 generated in the first tank 202 flow toward the second tank 204 side due to a negative pressure. Therefore, the number of droplets in the first tank 202 is not increased. In addition, a flow-in amount can be controlled by controlling a flow speed of the first solvent 205 in the second tank 204.

The cavitation is caused, using the second ultrasonic vibrator 212 of a throw-in type, to act on the primary particles 111 flowing into the second tank 204 (particle splitting unit 203). When the second ultrasonic vibrator 212 of a throw-in type operates at 450 W, the cavitation occurs in a direction from a surface of the vibrator toward the second tank 204. The shock wave 110 generated during the cavitation collapse in the first solvent 205 of the second tank 204 acts on the primary particles 111. Then, finer secondary particles 112 can be obtained. The size of the secondary particles 112 can be controlled by controlling the time during which the cavitation is caused to act. As the time is lengthened, the particle diameter of the metal microparticles decreases. In the present embodiment, the temperature of the first temperature measurement unit 215 in the second tank 204 was controlled to be 110° C. and the temperature of the second temperature measurement unit 216 was controlled to be 70° C.

Figure 8:
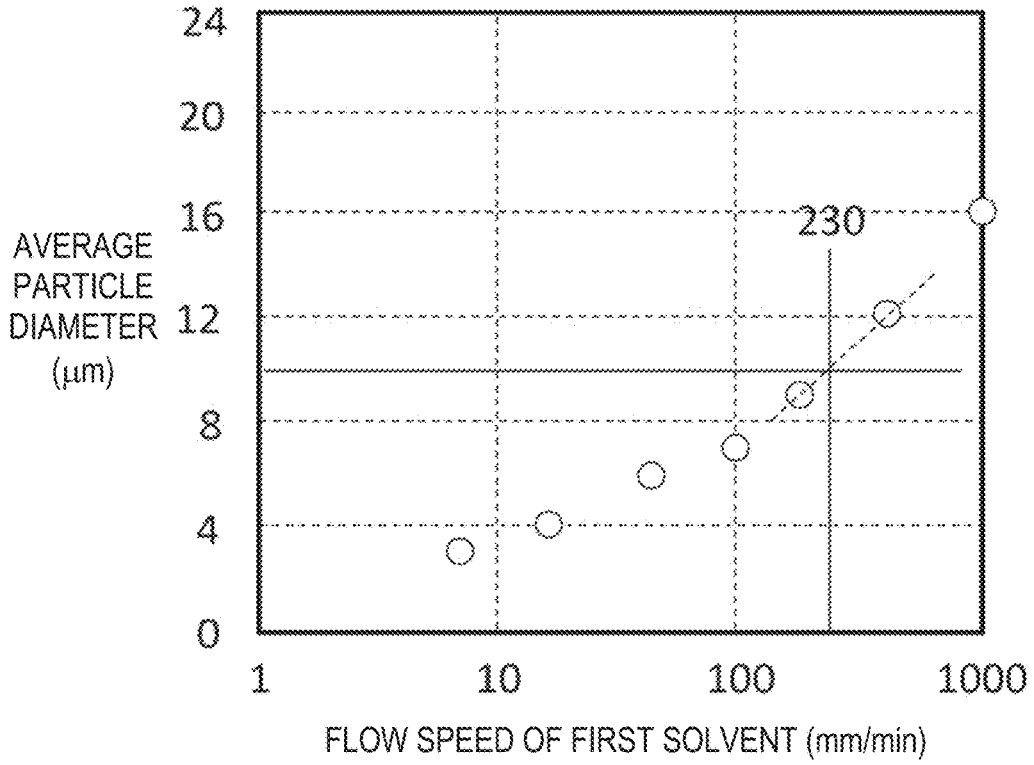
FIG. 8 is a diagram illustrating a relationship between a flow speed of a solvent and an average particle diameter of metal microparticles according to the second embodiment.

FIG. 8 is a diagram illustrating a relationship between the flow speed of the first solvent 205 in the second tank 204, and an average particle diameter of the secondary particles 112 after separation by the particle separating device 218. The average particle diameter is a median diameter measured using a laser diffraction/scattering particle diameter distribution measurement device. As the flow speed decreases, the average particle diameter decreases. The average particle diameter is 10 μm at a flow speed of 230 mm/min. Thus, it is desired that the flow speed is 230 mm/min or lower.

Figure 9:
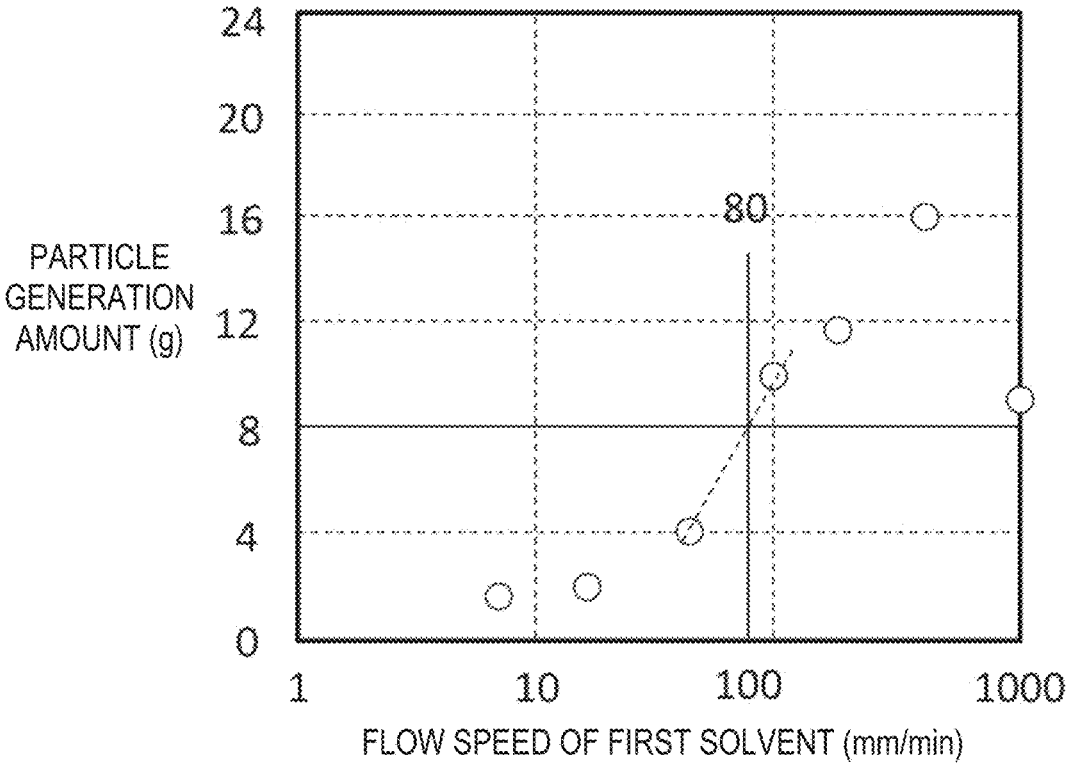
FIG. 9 is a diagram illustrating a relationship between the flow speed of the solvent and the mass of produced metal microparticles according to the second embodiment.

FIG. 9 is a diagram illustrating a relationship between the flow speed of the first solvent 205 in the second tank 204, and the mass of the secondary particles 112 obtained after separation by the particle separating device 218. Residues of the first solvent 205 were removed by a centrifugal separator, then the obtained substance was dried, and the mass of the secondary particles 112 was measured using a precision balance capable of measuring to 0.0001 g. The particle generation amount was the most at a flow speed of 500 mm/min, and decreased as the flow speed decreases. At a flow speed of 80 mm/min, the particle generation amount is 50% of that at a flow speed of 500 mm/min. Thus, it is desired that the flow speed is set at 80 mm/min or more. Therefore, it is desired that the flow speed of the first solvent 205 in the second tank 204 is set to be between 80 mm/min and 230 mm/min in order to achieve both a small average particle diameter and a large amount of the metal microparticles.

The temperature of the first temperature measurement unit 215 and the temperature of the second temperature measurement unit 216 are not limited to 110° C. and 70° C., respectively, and may be arbitrarily changed according to the melting point of the metal lump 107. The temperature measurement unit is not limited to two, and may be increased to three or more. The temperature management accuracy can be improved by increasing the temperature measurement unit.

In the present embodiment, the irradiation is performed with the ultrasonic waves to split the particles both in the particle generating unit 201, which irradiates the metal lump 107 with the ultrasonic wave and causes the shock wave 110 generated during the cavitation collapse to act, and in the particle splitting unit 203, a place different from the particle generating unit 201.

Accordingly, metal microparticles having a particle diameter of 1 μm to 10 μm can be efficiently produced. Further, when the particle diameter of the metal microparticles is desired to be small, the flow speed of the first solvent 205 that flows through the particle splitting unit 203 (the second tank 204) is reduced, so that the metal microparticles having a small particle diameter can be produced without reducing the particle generation amount.

According to the metal microparticle production device of the disclosure, by separately providing the particle generating unit 201 and the particle splitting unit 203, the particle generation rate is not reduced in the production of particles having a diameter of 1 μm to 10 μm.

In the metal microparticle production method and the metal microparticle production device of the first and second embodiments, since the generation of the primary particles and the splitting of the primary particles are performed in different steps, the primary particles can be split without reducing the generation amount of the primary particles. Therefore, the metal microparticles can be produced efficiently. Further, the ultrasonic wave irradiation time can be changed by adjusting the flow speed of the solvent (and thus the primary particles) in the particle splitting unit. Therefore, metal microparticles of having an arbitrary particle diameter can be obtained, and the metal microparticles can be applied to soldering an electronic circuit substrate or the like that requires micro bonding.

Third Embodiment

Hereinafter, the embodiment of the disclosure will be described with reference to the drawings. The matters not described are the same as those in the first and second embodiments.

<Metal Particle Production Process>

Figure 10:
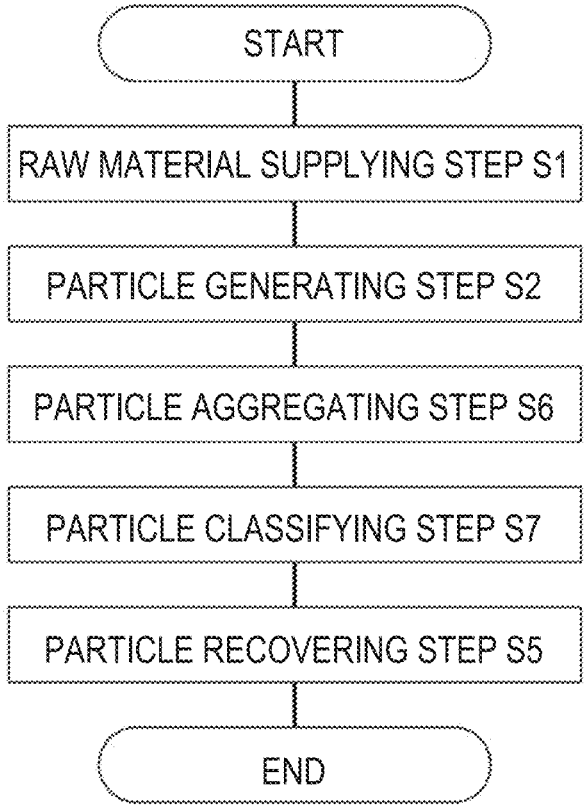
FIG. 10 is a flowchart illustrating a metal particle production process according to a third embodiment.

First, a metal particle production process according to an embodiment of the disclosure will be described. FIG. 10 is a flowchart illustrating a metal particle production process according to a third embodiment of the disclosure.

As shown in FIG. 10, the metal particle production process includes the raw material supplying step S1, the particle generating step S2, a particle aggregating step S6, a particle classifying step S7, and the particle recovering step S5.

In the raw material supplying step S1, the solid-state metal lump 107, which is the raw material of the metal particles, is supplied into the first solvent 205.

In the particle generating step S2, the first solvent 205 is irradiated with an ultrasonic wave, and the shock wave 110 of cavitation is caused to act to crush the surface of the metal lump 107 to generate the primary particles 111.

In the particle aggregating step S6, the primary particles 111 generated in the particle generating step S2 are irradiated with an ultrasonic wave, and the primary particles are brought into contact with each other to aggregate, so as to generate tertiary particles 113.

In the particle classifying step S7, the first solvent 205, containing both the tertiary particles 113 that are generated in the particle aggregating step S6 and the primary particles 111 that do not aggregate when the particle aggregating step S6 ends, is flowed in one direction, a magnetic field is applied to the flow, and the tertiary particles 113 and the primary particles 111 are classified by using a difference in magnetic force due to a difference in particle size.

In the particle recovering step S5, the tertiary particles 113 classified in the particle classifying step S7 are recovered.

<Description of Particle Generating Step S2>

Figure 11:
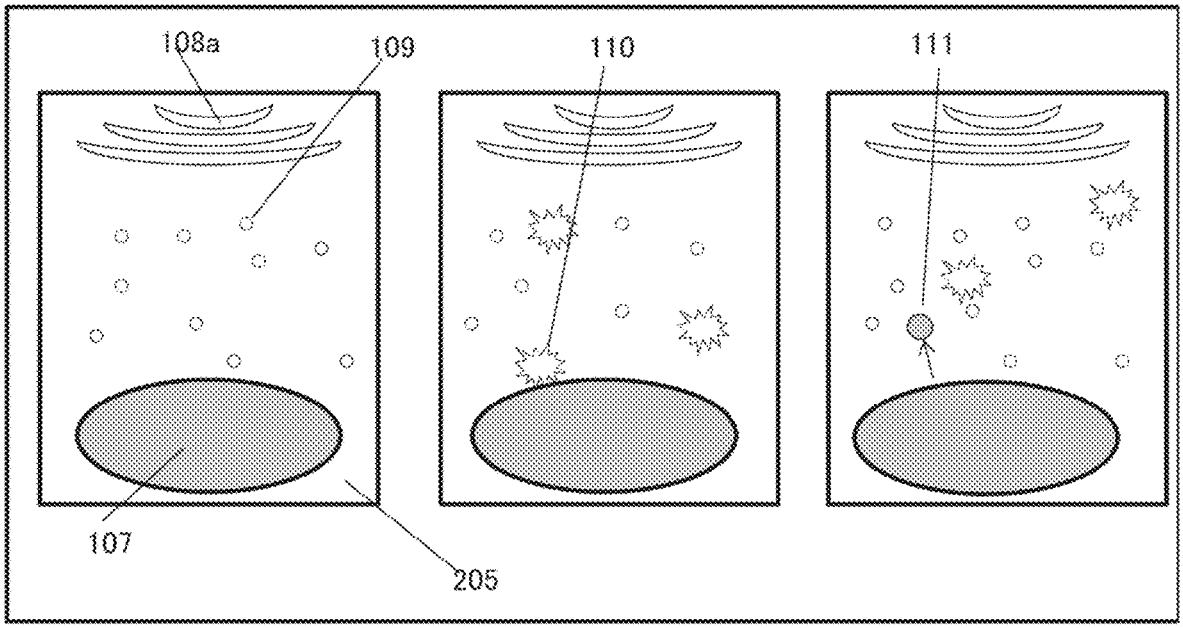
FIG. 11 is a diagram illustrating a particle generating step S2 according to the third embodiment.

FIG. 11 is a conceptual diagram illustrating a state where the primary particles 111 are generated using the ultrasonic wave 108*a* in the particle generating step S2. In general, the ultrasonic wave 108*a* is propagated as a compressional wave in the liquid. As shown in FIG. 11, when the first solvent 205 is irradiated with the ultrasonic wave 108*a*, minute air bubbles 109 are generated in the first solvent 205 due to the compressional wave. The air bubbles 109 repeat expansion and contraction, which is caused by pressure fluctuations in the first solvent 205 due to the compressional wave, to grow gradually. Further, when the greatly grown air bubbles 109 are unable to withstand the contraction, the air bubbles 109 are crushed, and the high pressure shock wave 110 is generated. This phenomenon is generally referred to as cavitation. The shock wave 110 acts on the surface of the metal lump 107 to crush the surface of the metal lump 107, and the primary particles 111 are generated. The primary particles 111 are generally about several nm in size.

Different from the particle generating step S2 in the first and second embodiments, the metal lump 107 is not melted and is in a solid state.

<Ultrasonic Wave>

With respect to the frequency of the ultrasonic wave 108*b* used in the particle generating step S2, a low frequency is more preferable since the shock wave 110 generated during the crushing of the air bubbles 109 is large with the ultrasonic wave 108*b* of a low frequency. When the shock wave 110 is large, the primary particles 111 can be efficiently generated in the particle generating step S2. Specifically, the frequency of the ultrasonic wave is preferably 15 kHz to 100 kHz, and most preferably 20 kHz to 30 kHz.

<Description of Particle Aggregating Step S6>

Figure 12:
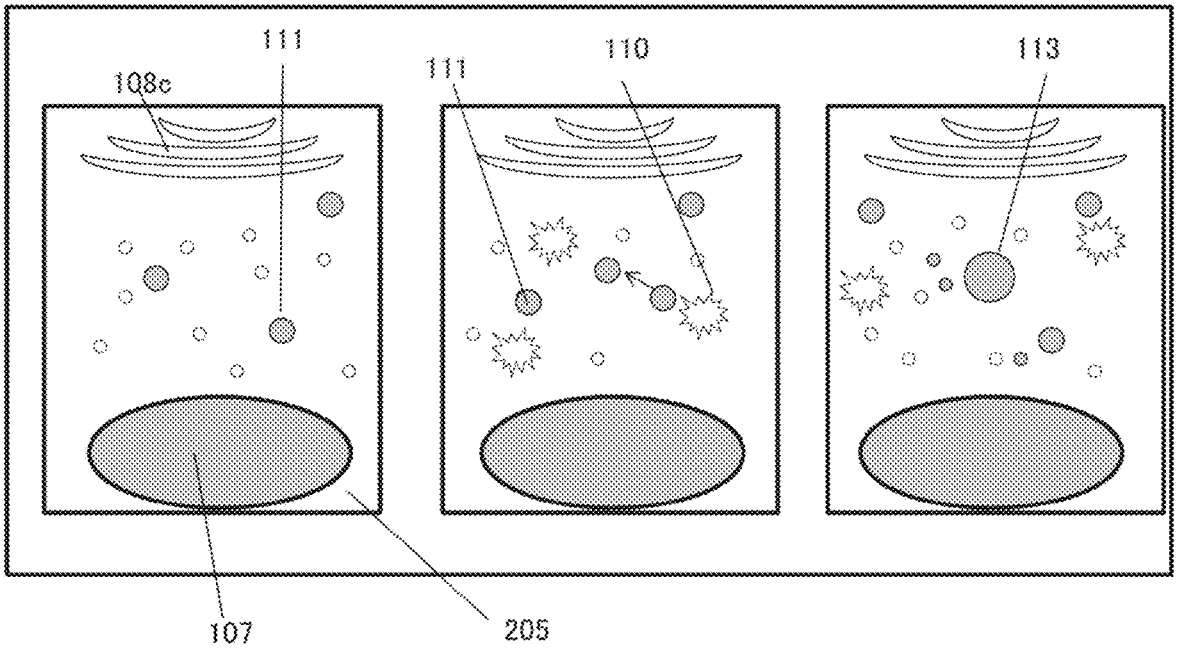
FIG. 12 is a diagram illustrating a particle aggregating step S6 according to the third embodiment.

FIG. 12 is a conceptual diagram illustrating a state where the particles are aggregated using an ultrasonic wave 108*c* in the particle aggregating step S6. As shown in FIG. 12, when the shock wave 110 is generated during the crushing of the air bubbles 109, with the primary particles 111 suspending in the first solvent 205, the primary particles 111 are repelled and moved by the shock and come into contact with other primary particles 111. The primary particles 111 are aggregated when coming into contact with each other. The tertiary particles 113 are generated by repeating this process a plurality of times.

With respect to the frequency of the ultrasonic wave 108*c* used in the particle aggregating step S6, it is more preferable to use an ultrasonic wave of a frequency higher than that in the particle generating step S2 since the ultrasonic wave is used for aggregation instead of crushing. In particular, by using an ultrasonic wave of a high frequency, the chance of the occurrence of the cavitation can be increased, and the tertiary particles 113 can be efficiently generated.

Further, with respect to the output of the ultrasonic wave, since the amplitude of the vibration wave can be increased at a high output, an effect of growing the air bubbles 109 is strong, and the shock wave 110 generated during the crushing of the air bubbles 109 can be increased.

Therefore, in the particle generating step S2 and the particle aggregating step S6, the output of the ultrasonic wave is most preferably 300 W to 1200 W. This is because the shock wave 110 is weak at a low output of about 200 W, while an ultrasonic vibration device capable of oscillating an ultrasonic wave with an output higher than 1200 W is expensive.

<Metal Lump 107>

The metal lump 107 serving as a raw material of the metal particles may be a metal including at least one element of Sn, Ag, Cu, Sb, Bi, In, or Au, or an alloy thereof, and may be a metal oxide made from these metals. In order to generate the primary particles 111 efficiently, the size of the metal lump 107 is most preferably about 10 μm to 1000 μm both in height and width. The reason for this is as follows. With a size of 10 μm or less, the metal lump 107 is repelled by the shock wave 110 when hit by the shock wave 110, and the efficiency of generating the primary particles 111 is low. With a size of 1000 μm or more, since a proportion of the surface area to the volume of the metal lump 107 is reduced and the probability of the shock wave 110 acting on the metal lump 107 is low, the efficiency of generating the primary particles 111 is low as a result.

<Particle Classifying Step S7>

In the particle classifying step S7, as described above, the primary particles 111 and the tertiary particles 113 are classified by applying a magnetic field perpendicular to a flow direction of the first solvent 205 to the metal particles (the primary particles 111 and the tertiary particles 113) contained in the flow of the first solvent 205. The classification method in the particle classifying step S7 will be described in detail below.

Figure 13:
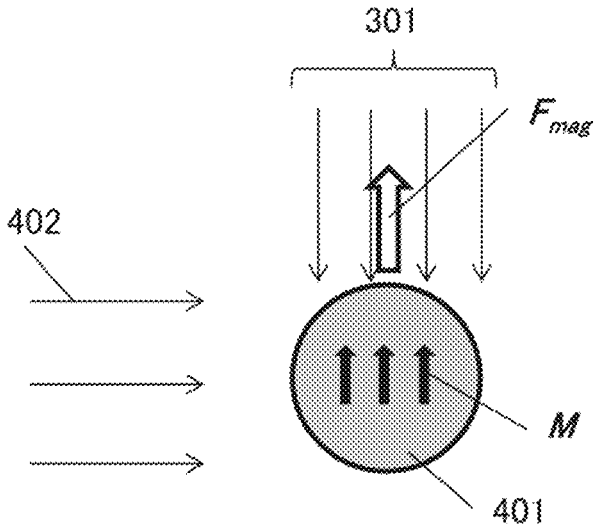
FIG. 13 is a diagram illustrating a particle classifying step S7 according to the third embodiment.

FIG. 13 is a conceptual diagram illustrating a magnetic force acting on a metal particle 401 due to a magnetic field 301. In the magnetic field 301, a magnetic volume force $F_{mag}$ acts on the metal particle 401. The magnetic volume force $F_{mag}$ can be expressed by the following Expression (1).

$$F_{mag}=M\Delta HV=\chi H\Delta HV \quad (1)$$

In Expression (1), M represents magnetization [A/m], H represents magnetic field strength [A/m], $\chi$ represents magnetic susceptibility [$m^3$/kg] of the metal particle 401 that is a magnetic material, ΔH represents magnetic field gradient [A/m], and V represents the volume [$m^3$] of the metal particle 401. The magnetic volume force $F_{mag}$, the magnetization M, and the magnetic field H are vector quantities, and the magnetic susceptibility $\chi$, the magnetic field gradient ΔH, and V are scalar quantities. A flow direction 402 of the solvent is shown in FIG. 13.

As shown in Expression (1), the magnitude of the magnetic volume force $F_{mag}$ can be expressed by a product of the volume V of the metal particle 401, the magnetization M, and the magnetic field gradient ΔH. It can be seen from Expression (1) that the larger the volume of the metal particles 401, the larger the magnetic volume force $F_{mag}$ acts. That is, as described above, since a volume of the tertiary particle 113 is larger than that of the primary particle 111, a magnetic volume force $F_{mag_202}$ acting on the tertiary particle 113 is larger than a magnetic volume force $F_{mag_201}$ acting on the primary particles 111. In the particle classifying step S7, the primary particles 111 and the tertiary particles 113 are classified using this principle.

A direction of the magnetic volume force $F_{mag}$ is determined by a direction of the magnetization M of the metal particle 401. The magnetization M can be expressed by a product of the magnetic field strength H and the magnetic susceptibility $\chi$ of the metal particle 401, and the direction of the magnetic volume force $F_{mag}$ can be controlled by controlling a direction of the magnetic field according to a positive or negative value of the magnetic susceptibility $\chi$ of the metal particle 401.

TABLE 2

| Magnetic susceptibility | $m^3$/kg |
|---|---|
| Sn | $-3.14159 \times 10^{-9}$ |
| Cu | $-1.08071 \times 10^{-10}$ |
| Bi | $-1.68389 \times 10^{-9}$ |

Table 2 shows the magnetic susceptibility of metal materials Sn, Cu, and Bi that can be the material of the metal lump 107. As can be seen from Table 2, when the metal particle 401 is made of Sn, Cu, or Bi, since the magnetic susceptibility $\chi$ of any of Sn, Cu, and Bi is $\chi<0$, the metal particle 401 is a diamagnetic material. In this case, as shown in FIG. 13, the direction of the magnetic volume force $F_{mag}$, is opposite to the direction of the magnetic field 301.

On the other hand, when the metal particle 401 is a ferromagnetic material (for example, Co, Ni, or an alloy thereof), since the magnetic susceptibility $\chi>0$, the direction of the magnetic volume force $F_{mag}$ is the same as the direction of the magnetic field 301.

<Metal Particle Production Device 200>

Figure 14:
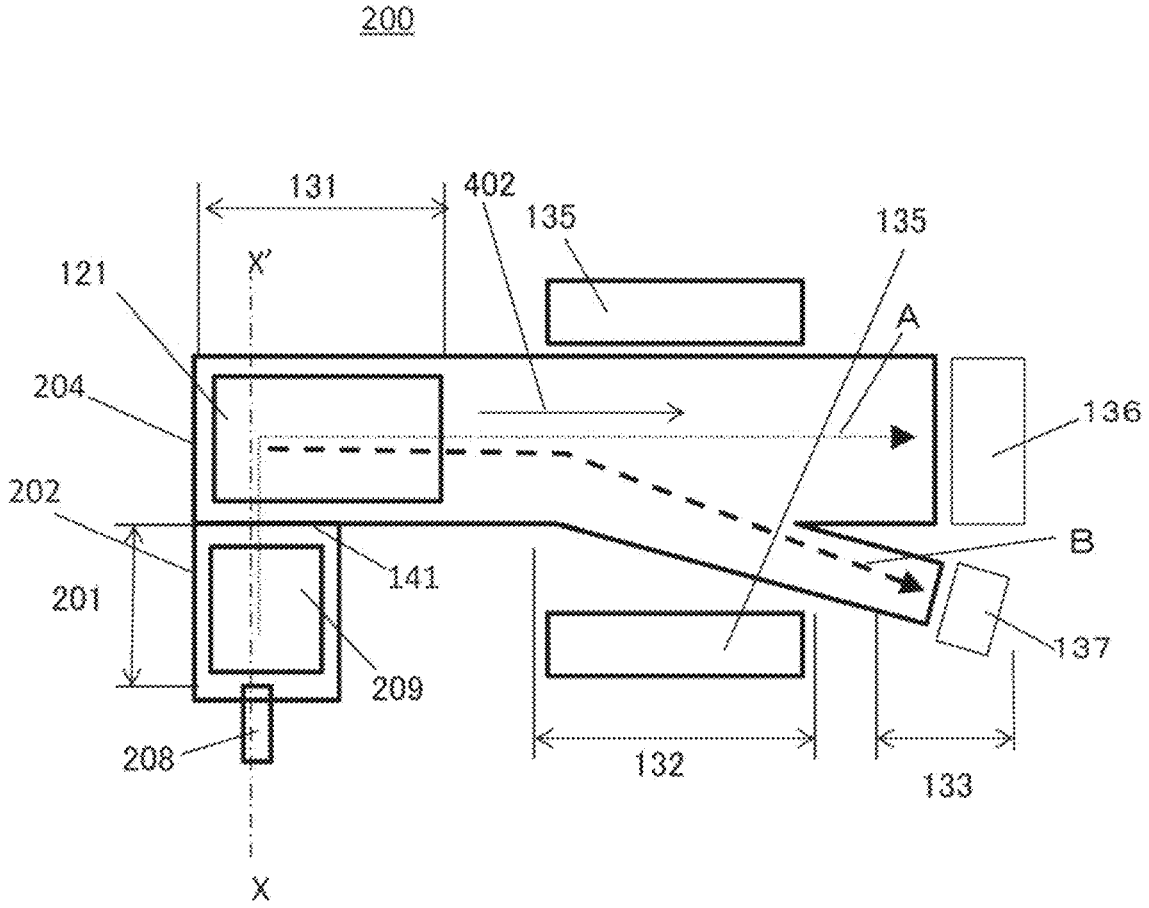
FIG. 14 is a schematic diagram of a metal particle production device as viewed from above according to the third embodiment.

Next, a metal particle production device 200 that is capable of implementing the metal particle production process described above will be described. FIG. 14 is a schematic diagram of the metal particle production device 200 as viewed from above according to the third embodiment of the disclosure. Further, FIG. 15 is a schematic diagram of a cross section of the metal particle production device 200 according to the third embodiment of the disclosure, and is a cross section taken along X-X' in FIG. 14.

As shown in FIG. 14, the metal particle production device 200 according to the embodiment of the disclosure includes the raw material supply unit 208, the particle generating unit 201, a particle aggregating unit 131, a particle classifying unit 132, and a particle recovering unit 133.

Figure 15:
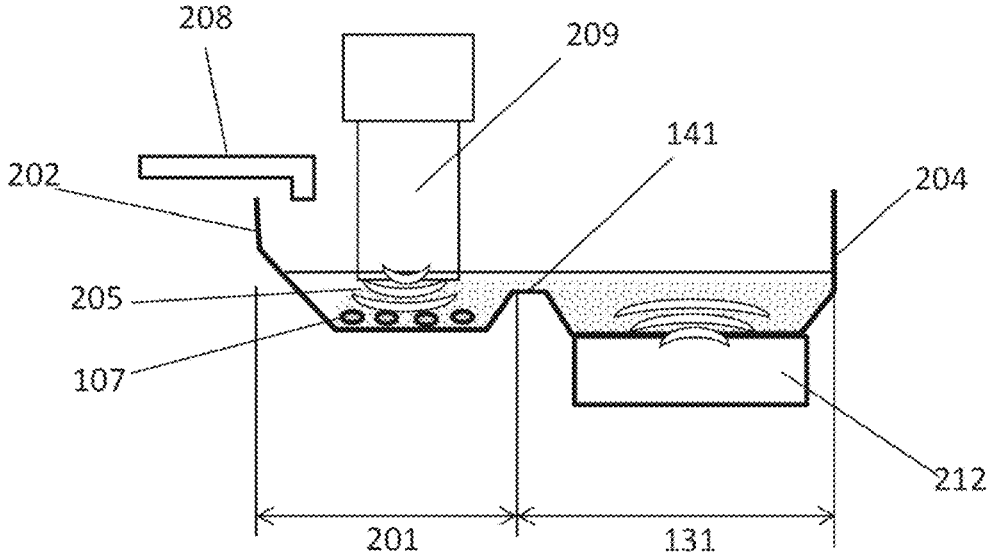
FIG. 15 is a schematic diagram of a cross section of the metal particle production device according to the third embodiment.

As shown in FIGS. 14 and 15, the particle generating unit 201 is implemented in the first tank 202. The particle aggregating unit 131 and the particle classifying unit 132 are implemented in the second tank 204. The second tank 204 is a tank through which the first solvent 205 can flow. As shown in FIG. 15, the partition 141 is provided between the first tank 202 and the second tank 204.

<Raw Material Supply Unit 208>

The raw material supply unit 208 supplies the metal lump 107 serving as the raw material of the metal particles and the first solvent 205 to the particle generating unit 201 of the first tank 202. Since the first solvent 205 is supplied in an amount larger than that of the metal lump 107 in comparison, the first solvent 205 is stored in an amount that makes the first solvent 205 higher than the partition 141.

On the other hand, since the metal lump 107 is in an amount smaller than that of the first solvent 205 in comparison and has a large specific gravity, the metal lump is disposed at the bottom of the first tank 202. In such a state, the metal lump 107 does not move over the partition 141, while the surface of the first solvent 205 is above the partition 141 such that the first solvent 205 can flow from the first tank 202 to the second tank 204 over the partition 141.

In the example described above, the metal lump 107 and the first solvent 205 are supplied from the raw material supply unit 208 to the particle generating unit 201. Alternatively, for example, a certain amount of the first solvent 205 may be stored in advance in the first tank 202.

<Particle Generating Unit 201>

The particle generating unit 201 generates the primary particles 111 by crushing the surface of the metal lump 107 in the first solvent 205. That is, in the particle generating unit 201, the particle generating step S2 of the metal particle production process shown in FIG. 10 is performed. As shown in FIG. 15, in the particle generating unit 201, the first ultrasonic vibrator 209 that emits an ultrasonic wave is provided in the first tank 202. The first ultrasonic vibrator 209 irradiates the particle generating unit 201 with the ultrasonic wave under the control of a control unit (not shown), so as to generate the primary particles 111 from the metal lump 107.

The first solvent 205 containing the primary particles 111 generated in such a manner flows from the particle generating unit 201 to the particle aggregating unit 131 over the partition 141. An arrow A shown in FIG. 14 approximately indicates a direction in which the first solvent 205 flows. At this time, the metal lump 107 does not move over the partition 141. The flow of the solvent in the first tank 202 is caused by, for example, the first solvent 205 (including the metal lump 107) supplied from the raw material supply unit 208 flowing into the particle generating unit 201. The flow of the solvent in the second tank 204 may be caused by a pump (not shown).

<Particle Aggregating Unit 131>

The particle aggregating unit 131 aggregates the primary particles 111 to generate larger tertiary particles 113. That is, the particle aggregating step S6 of the metal particle production process shown in FIG. 10 is performed by the particle aggregating unit 131. As shown in FIG. 15, in the particle aggregating unit 131, the second ultrasonic vibrator 212 that emits an ultrasonic wave is provided below the second tank 204. The second ultrasonic vibrator 212 irradiates the particle aggregating unit 131 with the ultrasonic wave under the control of a control unit (not shown) to cause aggregation of the primary particles 111, thereby generating the tertiary particles 113.

The first solvent 205 containing the tertiary particles 113 generated in such a manner flows along the flow direction 402 of the solvent to the particle classifying unit 132. In the particle aggregating unit 131, it is difficult to aggregate all the primary particles 111 generated by the particle generating unit 201 into the tertiary particles 113. Therefore, the first solvent 205 in which the primary particles 111 and the tertiary particles 113 are mixed is flowed into the particle classifying unit 132.

<Particle Classifying Unit 132>

The particle classifying unit 132 classifies the primary particles 111 and the tertiary particles 113. That is, the particle classifying unit 132 performs the particle classifying step S7 of the metal particle production process shown in FIG. 10. An electromagnet 135 is disposed in the particle classifying unit 132 so as to generate a magnetic field in a direction perpendicular to the flow of the first solvent 205. The primary particles 111 and the tertiary particles 113 flowing into the particle classifying unit 132 receive a force in a direction perpendicular to the flow of the first solvent 205 due to the magnetic field generated by the electromagnet 135. As described above, this force acts more significantly on the tertiary particles 113 having a relatively large volume than on the primary particles 111 having a relatively small volume. Therefore, in the particle classifying unit 132, the primary particles 111 and the tertiary particles 113 move along different flows of the first solvent 205, respectively. Specifically, the primary particles 111 flow along the original flow direction A of the first solvent 205, and the tertiary particles 113 flow away from the flow direction A of the first solvent 205 and start to flow in a direction B shown in FIG. 14, with direction thereof changed.

The particle classifying unit 132 can also be used in the first, second, and fourth embodiments.

<Particle Recovering Unit 133>

The particle recovering unit 133 recovers the primary particles 111 and the tertiary particles 113. The recovering method is not particularly limited. For example, in the particle recovering unit 133, a hole (not shown) for recovery is provided on a bottom surface of the second tank 204, and the primary particles 111 and the tertiary particles 113 may be recovered therefrom.

As shown in FIG. 14, in the particle recovering unit 133, the second tank 204 has a structure that is divided into two parts. The two parts are a first recovering unit 136 for recovering the primary particles 111 and a second recovering unit 137. As shown in FIG. 14, the first recovering unit 136 is provided at a position where the primary particles 111 flowing along the flow direction A of the first solvent 205 can be recovered. Meanwhile, the second recovering unit 137 is provided at a position where the tertiary particles 113, which starts to flow in the direction B due to the application of the magnetic volume force by the electromagnet 135 in the particle classifying unit 132, can be recovered. Accordingly, the primary particles 111 and the tertiary particles 113 can be efficiently and accurately classified and recovered.

<Functions and Effects>

The metal particle production device 100 according to the disclosure includes: the particle generating unit 201 that generates the primary particles 111 by crushing the surface of the metal lump 107; the particle aggregating unit 131 that aggregates the primary particles 111 to generate the tertiary particles 113 larger than the primary particles 111; a particle classifying unit 132 that classifies the primary particles 111 and the tertiary particles 113 by applying a magnetic field perpendicular to the flow of the first solvent 205 containing the primary particles 111 and the tertiary particles 113; and a particle recovering unit 133 that recovers the primary particles 111 and the tertiary particles 113 separately which are classified.

With such a configuration, the primary particles 111 and the tertiary particles 113 in the first solvent 205 can be classified accurately and efficiently. Metal microparticles having a particle diameter of 1 μm to 10 μm can be efficiently produced under the ultrasonic wave conditions. Particle having other particle diameters can also be produced.

<Modification>

Various embodiments have been described above with reference to the drawings, but the disclosure is not limited to these embodiments. It will be apparent to those skilled in the art that various changes and modifications can be conceived within the scope of the claims, and it is understood that such changes and modifications belong to the technical scope of the disclosure. Constituent elements in the embodiments described above may be arbitrarily combined within a range not departing from the spirit of the disclosure.

In the embodiment described above, one particle generating unit 201 is provided as shown in FIG. 14. However, in the disclosure, a plurality of raw material crushing units may be provided in order to increase the generation amount of the primary particles 111.

Figure 16:
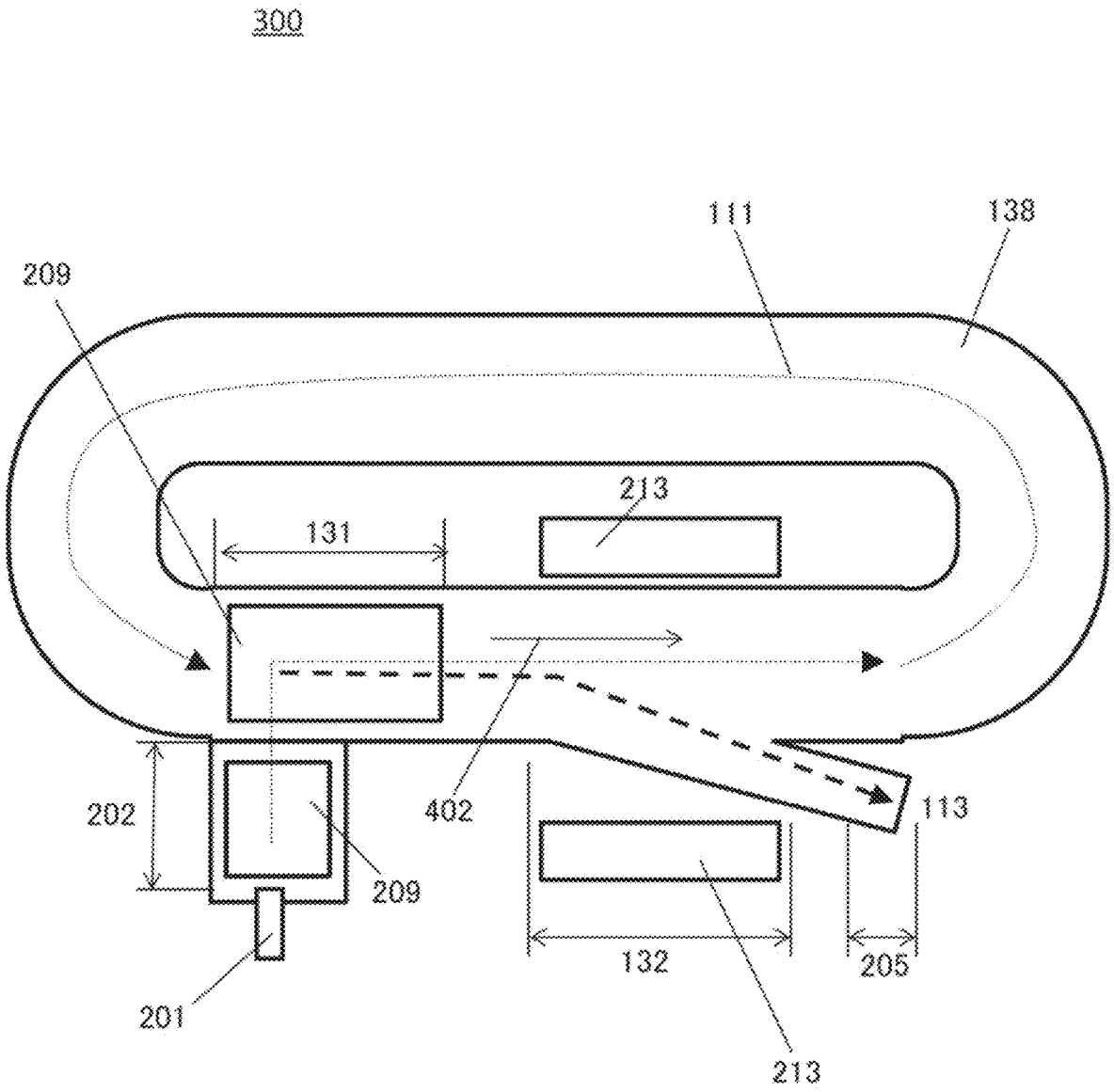
FIG. 16 is a plan view of a metal particle production device of a modification of the metal particle production device according to the third embodiment.

Examples of a modification of the metal particle production device 200 shown in FIG. 14 include a metal particle production device 300 having the following form. FIG. 16 is a plan view illustrating the metal particle production device 300 according to the modification. FIG. 16 is a schematic diagram of the metal particle production device 300 as viewed from above. The metal particle production device 300 is different from the metal particle production device 200 in that a re-aggregation flow path 138 is provided downstream of the particle recovering unit 133. As shown in FIG. 16, the re-aggregation flow path 138 connects a downstream side of the first recovering unit 136 of the particle recovering unit 133 and an upstream side of the particle aggregating unit 131 to each other. Accordingly, the primary particles 111 that cannot be recovered by the first recovering unit 136 reach the particle aggregating unit 131 again through the re-aggregation flow path 138, and become the target of the particle aggregating step in the particle aggregating unit 131. According to such a configuration, the loss of the metal particles is reduced, which is thus more preferable.

Fourth Embodiment

Hereinafter, a fourth embodiment of the disclosure will be described in detail.

<Description of Configuration of Metal Particle Production Device>

Figure 17:
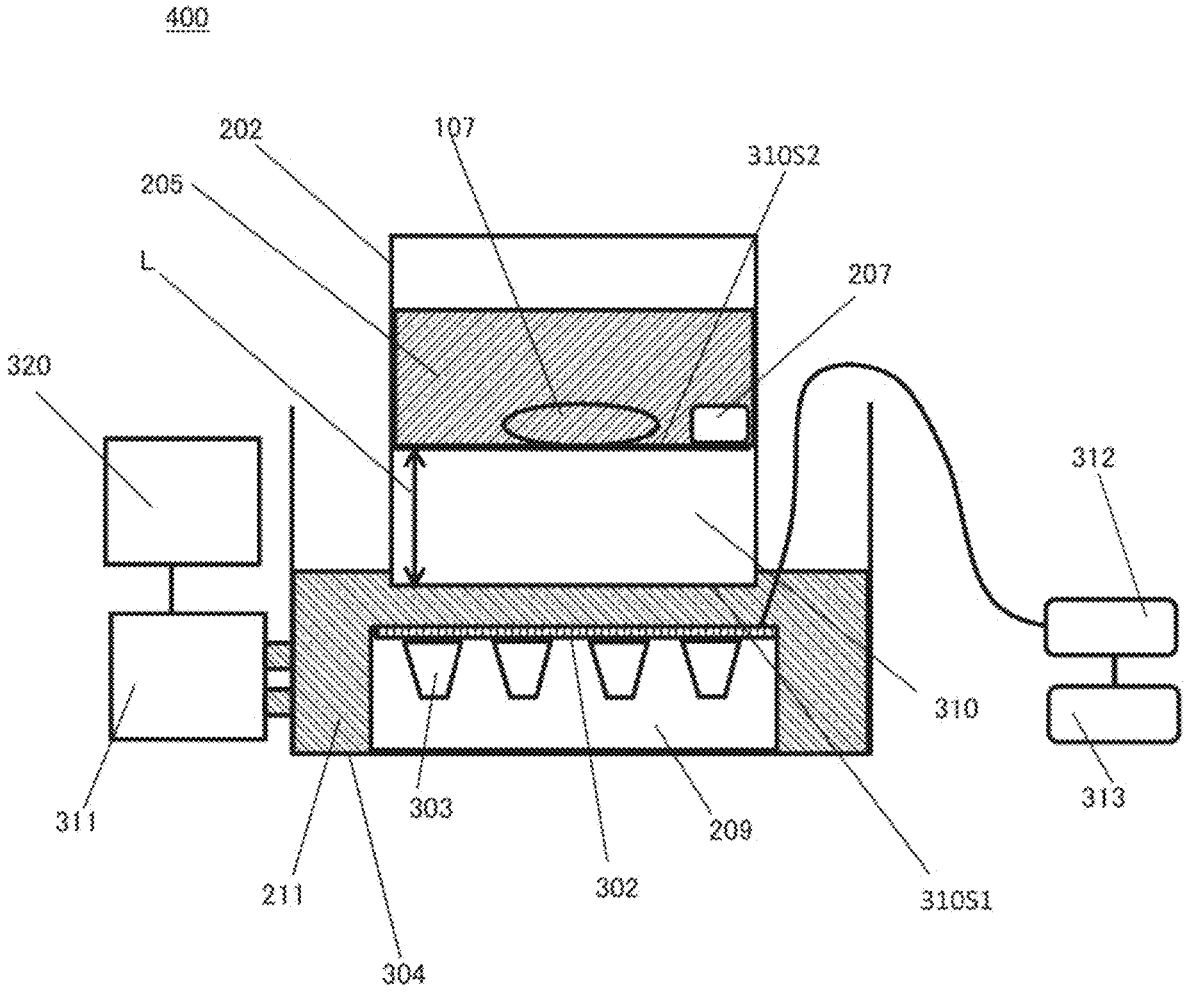
FIG. 17 is a cross-sectional view of a metal particle production method according to a fourth embodiment.

FIG. 17 is a diagram illustrating a configuration of a metal particle production device 400 according to a fourth embodiment. FIG. 17 shows a cross-sectional view of the metal particle production device 400 taken along a direction in which the ultrasonic wave is radiated. Here is an example in which particles having a particle diameter of 1 μm to 10 μm are produced when a melting point of a metal is 200° C. or higher. The first tank 202 and the second tank 204 of the first and second embodiments can be used.

As shown in FIG. 17, the metal particle production device 400 includes the first ultrasonic vibrator 209, the first tank 202, and a propagation unit 310.

The first ultrasonic vibrator 209 is a throw-in type oscillator. The first ultrasonic vibrator 209 includes a vibration plate 302 and a vibrator 303. The first ultrasonic vibrator 209 is connected to a matching box 312. The first ultrasonic vibrator 209 converts an electrical signal from the matching box 312 into ultrasonic vibration, and discharges the generated ultrasonic wave toward the second solvent 211.

The vibrator 303 generates vibration having a desired ultrasonic wave frequency. The vibration plate 302 converts the ultrasonic vibration generated by the vibrator 303 into uniform and planar vibration and radiates the vibration. The vibration plate 302 and the vibrator 303 are joined. The area of the vibration plate 302 is larger than the area of a bottom surface of the first tank 202.

A controller 313 is connected to the matching box 312. The controller 313 generates an electrical signal having a desired frequency and amplitude. The matching box 312 adjusts the electrical signal from the controller 313 to a waveform having a frequency suitable for the vibrator 303, and outputs the waveform to the vibrator 303.

The first ultrasonic vibrator 209 is disposed inside a propagation tank 304. The second solvent 211 is placed in the propagation tank 304. The second solvent 211 is used to propagate the ultrasonic wave emitted from the first ultrasonic vibrator 209 to the propagation unit 310, and to cool the first ultrasonic vibrator 209. The second solvent 211 is a liquid, for example, water.

The second solvent 211 is supplied into the propagation tank 304 in an amount that causes the first ultrasonic vibrator 209 to be completely immersed by the second solvent 211 and that causes an incidence surface 310S1, to be described below, of the propagation unit 310 to be covered with the second solvent 211.

As shown in FIG. 17, a cooler 311 is connected to the propagation tank 304. The second solvent 211 is circulated in the propagation tank 304 and the cooler 311, and is cooled by the cooler 311. The cooler 311 is controlled by a control unit 320. The cooler 311 is controlled by the control unit 320 to maintain a temperature T1 of the second solvent 211 at a desired temperature T1*d* or lower, and to make a temperature difference (T2−T1) between a temperature T2 of the first solvent 205 to be described below and the temperature T1 of the second solvent 211 at a constant value. Details of the control by the control unit 320 over the cooler 311 will be described below.

The first tank 202 is a tank for performing ultrasonic processing. The first tank 202 is disposed such that the ultrasonic wave emitted from the vibration plate 302 of the first ultrasonic vibrator 209 are vertically incident onto the bottom surface of the first tank 202 via the propagation unit 310.

The metal lump 107 is placed in the first tank 202 in a state of being immersed in the first solvent 205. The metal lump 107 is an object to be subjected to the ultrasonic processing. For example, the metal lump 107 is an ingot of Sn-3.0Ag-0.5Cu, which may be a solder material. The first solvent 205 is a liquid used for generating cavitation by the ultrasonic wave. The first solvent 205 is placed in the first tank 202 at least in an amount that allows the metal lump 107 to be covered with the first solvent 205. For example, silicone oil is used as the first solvent 205.

The propagation unit 310 propagates the ultrasonic wave, which is emitted from the first ultrasonic vibrator 209 and is incident from the incidence surface 310S1 through the second solvent 211, to a radiation surface 310S2 in contact with the bottom surface of the first tank 202, and then the ultrasonic wave is radiated into the first tank 202.

The incidence surface 310S1 of the propagation unit 310 is a surface of the propagation unit 310 provided on a first ultrasonic vibrator 209 side, and is a lower surface of the propagation unit 310 in the example illustrated in FIG. 17. As described above, the incidence surface 310S1 is covered with the second solvent 211. Therefore, the ultrasonic wave emitted from the first ultrasonic vibrator 209 is incident into the propagation unit 310 from the incidence surface 310S1 only through the second solvent 211 without passing through another solvent such as air.

Meanwhile, the radiation surface 310S2 of the propagation unit 310 is a surface of the propagation unit 310 provided on a first tank 202 side. More specifically, the radiation surface 310S2 is a surface of the propagation unit 310 in contact with the bottom surface of the first tank 202. The radiation surface 310S2 is provided at a position facing the incidence surface 310S1 in the propagation unit 310. In the example illustrated in FIG. 17, the radiation surface 310S2 is an upper surface of the propagation unit 310. The ultrasonic wave that is incident onto the propagation unit 310 from the incidence surface 310S1 propagates in the propagation unit 310 and is radiated from the radiation surface 310S2 to the first tank 202. Accordingly, the ultrasonic wave emitted by the first ultrasonic vibrator 209 is supplied into the first tank 202, and the ultrasonic processing is performed.

As shown in FIG. 17, the first heating unit 207 that heats the first solvent 205 is provided in the first tank 202. The temperature T2 of the first solvent 205 is controlled by the control unit 320 of the first heating unit 207. The first heating unit 207 is controlled by the control unit 320 to maintain the temperature T2 of the first solvent 205 at a desired temperature T2*d* or higher, and to make the temperature difference (T2−T1) between the temperature T2 of the first solvent 205 and the temperature T1 of the second solvent 211 at a constant value. Details of the control by the control unit 320 over the first heating unit 207 will be described below.

<Procedure of Ultrasonic Processing>

The configuration of the metal particle production device 400 has been described above. Next, a procedure of the ultrasonic processing in the metal particle production device 400 will be described.

First, the control unit 320 controls the first heating unit 207 to maintain the temperature T2 of the first solvent 205 at the desired temperature T2*d* or higher. For example, the desired temperature T2*d* is 200° C. or higher. The desired temperature T2*d* is a temperature at which the ultrasonic processing in the metal particle production device 400 is efficiently performed, and is appropriately set depending on, for example, contents of the ultrasonic processing, the material of the metal lump 107, and the material of the first solvent 205. The temperature T2 of the first solvent 205 may be measured by, for example, a sensor (not shown) provided in the first tank 202.

When the first solvent 205 is maintained at a high temperature higher than the desired temperature T2*d*, heat is transferred to the second solvent 211 via the first tank 202 and the propagation unit 310, and the temperature of the second solvent 211 also rises. Therefore, in order to prevent the influence of heat on the first ultrasonic vibrator 209 covered with the second solvent 211, the control unit 320 sequentially controls the cooler 311 such that the temperature T1 of the second solvent 211 is maintained at a desired temperature T1*d* or lower. The desired temperature T1*d* is, for example, a temperature equal to or lower than the heat-resistant temperature of the first ultrasonic vibrator 209, and is, for example, about 70° C. or lower. The temperature T1 of the second solvent 211 may be measured by, for example, a sensor (not shown) provided in the propagation tank 304.

Further, the control unit 320 controls the cooler 311 and the first heating unit 207 such that the temperature difference (T2−T1) between the temperature T2 of the first solvent 205 and the temperature T1 of the second solvent 211 is constant. That is, the control unit 320 controls the cooler 311 such that the temperature T1 of the second solvent 211 is maintained at the desired temperature T1*d* or lower and that the temperature difference (T2−T1) between the temperature T1 of the second solvent 211 and the temperature T2 of the first solvent 205 to be described below is a constant value.

Meanwhile, the control unit 320 controls the first heating unit 207 such that the temperature T2 of the first solvent 205 is maintained at the desired temperature T2*d* or higher and that the temperature difference (T2−T1) between the temperature T2 of the first solvent 205 and the temperature T1 of the second solvent 211 is a constant value. A reason why the cooler 311 and the first heating unit 207 is controlled such that the temperature difference (T2−T1) between the temperature T2 of the first solvent 205 and the temperature T1 of the second solvent 211 is constant will be described below.

Thus, in an operating state of the metal particle production device 400, the temperature T1 of the second solvent 211 is maintained at the desired temperature T1*d* or lower, and the temperature T2 of the first solvent 205 is maintained at the desired temperature T2*d* or higher. Then, the temperature difference (T2−T1) between the temperature T2 of the first solvent 205 and the temperature T1 of the second solvent 211 is constant. In this state, the first ultrasonic vibrator 209 radiates the ultrasonic wave for the ultrasonic processing from the vibration plate 302.

The ultrasonic wave radiated from the vibration plate 302 reaches the propagation unit 310 via the second solvent 211. Further, the ultrasonic wave, which is incident into the propagation unit 310 from the incidence surface 310S1 of the propagation unit 310, propagates in the propagation unit 310 and is radiated from the radiation surface 310S2 to the first tank 202. Accordingly, the cavitation occurs due to the ultrasonic wave in the first solvent 205 in the first tank 202. Cavitation is a phenomenon in which generation and disappearance of air bubbles occur in a short time in a liquid. A shock wave is generated during the air bubble collapse in cavitation, and the ultrasonic processing on the metal lump 107 is performed by the shock wave. Examples of the ultrasonic processing include pulverization processing in which the metal lump 107 is pulverized into powder.

<Thickness of Propagation Unit 310>

In order to efficiently perform the ultrasonic processing described above, it is necessary to efficiently propagate the ultrasonic wave incident on the propagation unit 310 to the first tank 202. Hereinafter, conditions that the thickness of the propagation unit 310 needs to satisfy for efficient propagation of the ultrasonic wave will be described in detail. The thickness of the propagation unit 310 refers to a distance from the incidence surface 310S1 to the radiation surface 310S2 (length L shown in FIG. 17). Hereinafter, the thickness of the propagation unit 310 is described as L.

The amount of heat generated by the first heating unit 207 is taken as Q, the heat conductivity of the propagation unit 310 is taken as k, the wavelength of the ultrasonic wave is taken as λ, and the area of the radiation surface 310S2 of the propagation unit 310 in contact with the bottom surface of the first tank 202 is taken as S. In this case, the thickness L of the propagation unit 310 is set such that the following Expressions (2) and (3) are satisfied.

$$0.95\times n\lambda/2\leq L\leq 1.05\times n\lambda/2 \quad (2)$$

$$L\geq[kS(T2-T1)]/Q \quad (3)$$

In Expression (2), n is a positive integer. In particular, n is preferably 2 to 4.

As shown in Expression (2), the thickness L of the propagation unit 310 is set to be a value within ±5% from a value that is an integral multiple of half (half wavelength) of the wavelength of the ultrasonic wave. The reason for this is as follows.

The ultrasonic wave emitted from the vibration plate 302 of the first ultrasonic vibrator 209 propagates in the second solvent 211 and the propagation unit 310 successively, and is radiated to the first solvent 205 in the first tank 202.

As described above, while the second solvent 211 and the first solvent 205 are liquids, the propagation unit 310 and the first tank 202 are solids. In general, since there is a large difference in acoustic impedance between liquid and solid, the acoustic impedance of the propagation unit 310 and the first tank 202 is greatly different from the acoustic impedance of the second solvent 211 and the first solvent 205.

Between substances having a large difference in acoustic impedance, ultrasonic waves are mostly reflected at a boundary surface thereof, and the intensity of ultrasonic waves that can pass through the boundary surface turns weak. As a method for preventing the reflection of the ultrasonic wave at such a boundary surface, there is a method in which the intensity of the ultrasonic wave is amplified by setting the thickness of a substance propagating the ultrasonic wave to a value that is an integral multiple of a half wavelength of the ultrasonic wave to cause resonance. That is, in the disclosure, attenuation of the ultrasonic wave at the boundary surface is prevented by setting the thickness L of the propagation unit 310 to approximately an integral multiple of the half wavelength of the ultrasonic wave.

Expression (2) is derived based on such a reason. In Expression (2), a value within ±5% from an integral multiple of the half wavelength of the ultrasonic wave is allowed. Since the thickness of the first tank 202 is sufficiently smaller than the thickness L of the propagation unit 310, the thickness of the first tank 202 is ignored.

Next, as shown in Expression (3), the thickness L of the propagation unit 310 is set depending on the temperature difference between the temperature T1 of the second solvent 211 and the temperature T2 of the first solvent 205, and on the amount Q of heat generated by the first heating unit 207. The reason for this is as follows.

As described above, it is necessary to maintain the temperature T2 of the first solvent 205 at the desired temperature T2*d* (about 200° C.) or higher, for a desired ultrasonic processing. Heat of the first solvent 205 is transferred to the second solvent 211 via the propagation unit 310 as described above, and the amount of heat q transferred from the first solvent 205 to the second solvent 211 via the propagation unit 310 per unit time is expressed by the following Expression (4).

$$q=kS(T2-T1)/L \quad (4)$$

Therefore, in order to maintain the temperature T2 of the first solvent 205 at the desired temperature T2*d* or higher, it is necessary to set the amount Q of heat generated by the first heating unit 207 to be larger than q in Expression (4). Therefore, the thickness L of the propagation unit 310 is set to be a value as shown in Expression (3).

<Wavelength λ of Ultrasonic Wave>

In Expression (2) described above, the wavelength λ of the ultrasonic wave is used as a parameter. Strictly speaking, the wavelength λ is not a wavelength of the ultrasonic wave oscillated by the first ultrasonic vibrator 209, but a wavelength of an ultrasonic wave passing through the propagation unit 310 and is influenced by a temperature of the propagation unit 310. Hereinafter, the wavelength λ of the ultrasonic wave passing through the propagation unit 310 will be described in detail.

In the metal particle production device 400, the materials and temperatures of the second solvent 211, the propagation unit 310, and the first solvent 205, through which the ultrasonic wave propagates when propagated are different from each other. Since the influence of the first tank 202 is small, the first tank 202 is ignored. Therefore, sound velocities and wavelengths of the ultrasonic wave propagating in the second solvent 211, the propagation unit 310, and the first solvent 205 can vary depending on physical properties and temperature of the substance that propagates the ultrasonic wave. In particular, since a temperature of a side in contact with the second solvent 211 and a temperature of a side in contact with the first solvent 205 are different in the propagation unit 310, there is a non-uniform temperature distribution in the propagation unit 310. Therefore, the speed and the wavelength of the ultrasonic wave propagating in the propagation unit 310 vary depending on the position.

It is empirically known that, in a steady state, the temperature distribution in the propagation unit 310 exhibits a substantially linear gradient from the side in contact with the second solvent 211 (the incidence surface 310S1 side) toward the side in contact with the first solvent 205 (the radiation surface 310S2 side). It is empirically known that the speed of the ultrasonic wave in a solid substance such as the propagation unit 310 varies substantially linearly within a range from a room temperature to 300° C. or lower. Therefore, as the wavelength λ of the ultrasonic wave appearing in Expression (2) described above, a wavelength λ of the ultrasonic wave passing through the propagation unit 310 in a case where the temperature of the propagation unit 310 is an intermediate temperature (T2−T1)/2 of the temperature T1 of the second solvent 211 and the temperature T2 of the first solvent 205 is used approximately.

As described above, in the metal particle production device 400 according to the present embodiment, the temperature difference (T2−T1) between the temperature T2 of the first solvent 205 and the temperature T1 of the second solvent 211 is controlled to be constant by the control unit 320. Therefore, even when the temperature T2 of the first solvent 205 is unintentionally changed, the wavelength λ of the ultrasonic wave passing through the propagation unit 310 can be made constant.

The case where the temperature T2 of the first solvent 205 is unintentionally changed is, for example, as follows. In the ultrasonic processing, the metal lump 107 may undergo a chemical reaction in the first solvent 205, and in such a case, reaction heat or the like may be generated due to the chemical reaction. In such a case, the temperature T2 of the first solvent 205 is unintentionally changed. As described above, even in such a case, in the metal particle production device 400 according to the present embodiment, the wavelength λ of the ultrasonic wave passing through the propagation unit 310 can be made constant.

Even when the frequency of the ultrasonic wave oscillated by the first ultrasonic vibrator 209 is appropriately controlled by the controller 313, the wavelength λ of the ultrasonic wave passing through the propagation unit 310 can be made constant. However, for example, when the frequency is controlled, the state of cavitation in the first tank 202 may change, and a reaction field of the chemical reaction may change. Therefore, as described above, it is more preferable to control the temperature T1 of the second solvent 211 by using the cooler 311 to make the temperature difference (T2−T1) constant.

EXAMPLES

Hereinafter, various examples of the metal particle production device 400 described above will be described, and effects of the disclosure will be described.

Example 1

Various conditions in Example 1 are as follows. Quartz glass (heat conductivity: 1.5 W/mK) was used for the first tank 202 and the propagation unit 310. The area S of the radiation surface 310S2 was 0.018 $m^2$ (diameter: 15 cm). In Example 1, the area S of the radiation surface 310S2 was the same as the area of the bottom surface of the first tank 202. Silicone oil (KF-96-50cs produced by Shin-Etsu Chemical Co., Ltd.) was used as the first solvent 205. Water was used as the second solvent 211. A solder (Sn-3.0Ag-0.5Cu, with a melting point of 219° C. and a weight of 10 g) was used as the metal lump 107.

The amount Q of heat generated by the first heating unit 207 was set to 500 W. The desired temperature T2*d* to which the first solvent 205 should be heated was set at 230° C., and the desired temperature T1*d* to which the second solvent 211 should be cooled was set to 20° C. Further, the control unit 320 sequentially controlled the cooler 311 to maintain (T2−T1)/2 at 115° C. When the temperature T1 of the second solvent 211 and the temperature T2 of the first solvent 205 were set to be the desired values, the sound speed inside the propagation unit 310 (quartz glass) was 5750 m/s.

The frequency of the ultrasonic wave was 26 kHz and the output was 300 W. In this case, the wavelength λ of the ultrasonic wave in a case where the sound speed was 5750 m/s was 221 mm.

The metal lump 107 was subjected to microparticle formation processing by the ultrasonic processing. A generation amount of powder and an average particle diameter of the generated powder were measured and evaluated. A specific flow of the ultrasonic processing is as follows.

First, the metal lump 107 was weighed and was put into the first tank 202 together with the first solvent 205.

The temperature T1 of the second solvent 211 was set to be the set temperature (20° C.) by using the cooler 311. The temperature T2 of the first solvent 205 was set to be the set temperature (230° C.) by using the first heating unit 207. The metal lump 107 in a molten state was irradiated with the ultrasonic wave from the first ultrasonic vibrator 209 for 20 minutes. Accordingly, the ultrasonic processing (pulverization processing) was performed in the first tank 202. Thereafter, the first tank 202 was cooled, the generated powder was separated by centrifugation and the separated powder was recovered. Then, the generation amount and the particle diameter of the recovered powder were measured. Results thereof are shown in Table 3 below.

In Examples 1-1 to 1-4 shown in Table 3, the evaluation is performed while changing the thickness L of the propagation unit 310 in a direction parallel to a traveling direction of the ultrasonic wave. That is, in the metal particle production device 400 according to the present embodiment, the thickness L is set to be an integral multiple (n times) of the half wavelength λ/2 as shown in Expression (2), and in Examples 1-1 to 1-4, the thickness L is changed by changing respective values of n. The column of ratio (L/λ) in Table 3 shows values of n/2 in respective examples.

Meanwhile, in Table 3, examples in which the thickness L is not an integral multiple of the half wavelength λ/2 are shown as Comparative Examples 1-1 to 1-4. Other conditions in Comparative Examples 1-1 to 1-4 are the same as those of Examples 1-1 to 1-4.

In addition, Table 3 shows results of a case where a configuration, in which a second processing tank is provided inside a processing tank and a solvent disposed between the two processing tanks is heated by a heater, that is, a configuration that assumes a case where a high-temperature process is performed with a metal particle production device in the related art, is adopted as Comparative Example 1-5.

Figure 18:
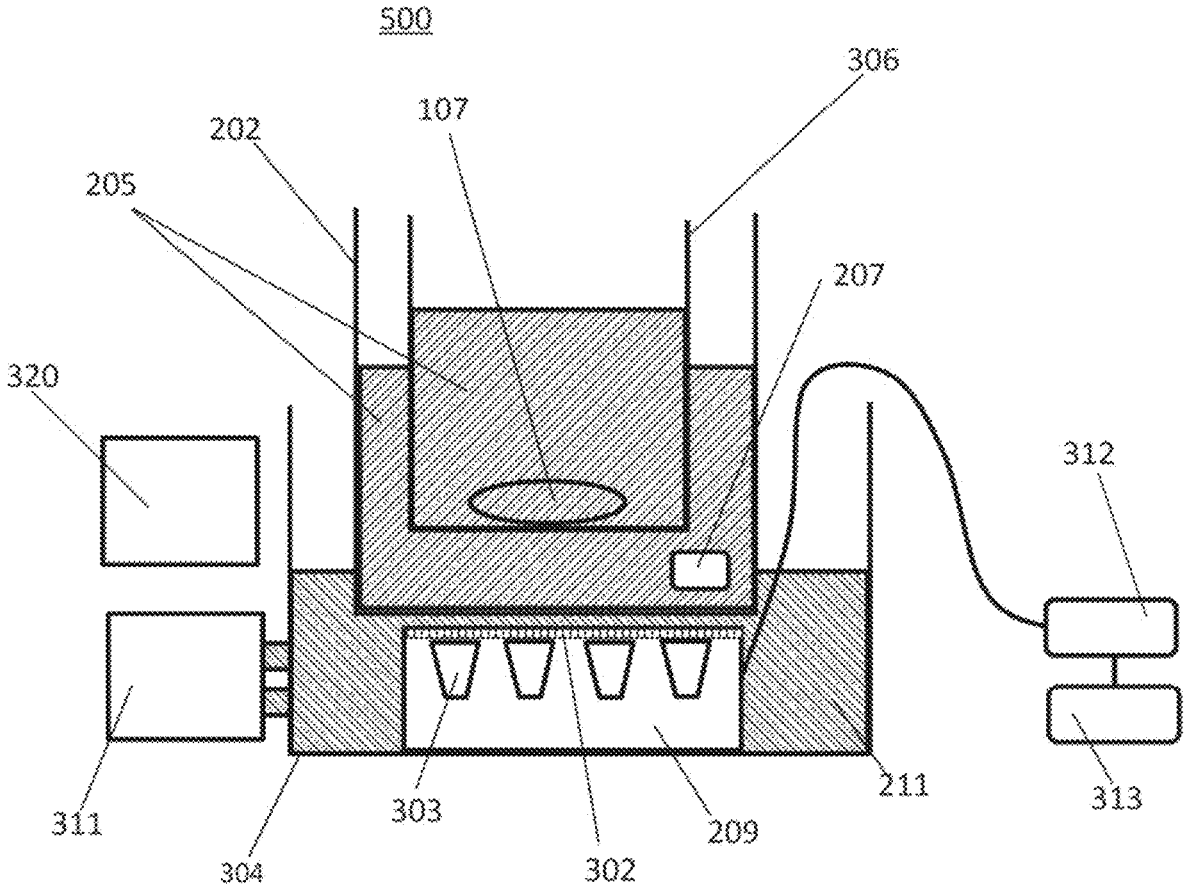
FIG. 18 RELATED ART
FIG. 18 is a cross-sectional view of a metal particle production device according to a comparative example.

FIG. 18 is a diagram illustrating an example of the configuration of the metal particle production device of Comparative Example 1-5. FIG. 18 is a cross-sectional view of a metal particle production device 500 of Comparative Example 1-5 parallel to an ultrasonic wave irradiation direction.

The metal particle production device 500 in Comparative Example 1-5 includes the first ultrasonic vibrator 209, the vibration plate 302, the vibrator 303, the propagation tank

TABLE 3

| | Thickness L (mm) | Heat conductivity (W/m · ° C.) | Area of bottom surface ($m^2$) | T2 − T1 (° C.) | Heat amount Q (W) |
|---|---|---|---|---|---|
| Example 1-1 | 111 | 1.5 | 0.018 | 210 | 500 |
| Example 1-2 | 221 | 1.5 | 0.018 | 210 | 500 |
| Example 1-3 | 332 | 1.5 | 0.018 | 210 | 500 |
| Example 1-4 | 442 | 1.5 | 0.018 | 210 | 500 |
| Comparative Example 1-1 | 55 | 1.5 | 0.018 | 210 | 500 |
| Comparative Example 1-2 | 83 | 1.5 | 0.018 | 210 | 500 |
| Comparative Example 1-3 | 166 | 1.5 | 0.018 | 210 | 500 |
| Comparative Example 1-4 | 5 | 1.5 | 0.018 | 210 | 500 |
| Comparative Example 1-5 | — | 1.5 | 0.018 | 210 | 500 |

| | L/λ | kS (T2 − T1)/Q (mm) | Generation amount (g) | Average particle diameter (μm) | Determination |
|---|---|---|---|---|---|
| Example 1-1 | 0.5 | 6.21 | 10 | 4 | ○ |
| Example 1-2 | 1.0 | 6.21 | 10 | 4 | ○ |
| Example 1-3 | 1.5 | 6.21 | 10 | 5 | ○ |
| Example 1-4 | 2.0 | 6.21 | 10 | 5 | ○ |
| Comparative Example 1-1 | 0.25 | 6.21 | 1.6 | 18 | x |
| Comparative Example 1-2 | 0.375 | 6.21 | 3.4 | 23 | Δ |
| Comparative Example 1-3 | 0.75 | 6.21 | 1.1 | 17 | x |
| Comparative Example 1-4 | 0.02 | 6.21 | 0.2 | 43 | x |
| Comparative Example 1-5 | — | — | 1.8 | 17 | — |

304, the first tank 202, the first heating unit 207, the cooler 311, the matching box 312, and the controller 313.

The second solvent 211 is placed in the propagation tank 304, and the first solvent 205 is placed in the first tank 202. Each of these components is provided for the same purpose as the component of the same name in the embodiments described above.

In the metal particle production device 500 of Comparative Example 1-5, a third heating tank 306 is provided in addition to the first tank 202. In Comparative Example 1-5, the third heating tank 306 is a tank in which the ultrasonic processing is performed, and the third heating tank 306 is disposed on an inner side of the first tank 202.

In the third heating tank 306, the first solvent 205 similar to that placed in the first tank 202 is placed, and the metal lump 107 is disposed so as to be covered with the first solvent 205. In Comparative Example 1-5, the first solvent 205 in the first tank 202 and the third heating tank 306 disposed on the inner side of the first tank 202 are heated by the first heating unit 207 disposed in the first tank 202.

In Comparative Example 1-5, the area of a bottom surface of the first tank 202 is 0.0018 $m^2$, and the area of a bottom surface of the third heating tank 306 on the inner side is 0.00095 $m^2$.

The determination column of Table 3 shows evaluation of the particle formation processing in each of Examples and Comparative Examples. In the determination column, a case where the total amount of the metal lump 107 is processed 20 minutes after the start of the ultrasonic wave irradiation is marked as "○"; a case where not the total amount is processed but the generation amount is larger than that in Comparative Example 1-5 20 minutes after the start of the ultrasonic wave irradiation is marked as "Δ"; and a case where not the total amount is processed and the generation amount is less than that in Comparative Example 1-5 20 minutes after the start of the ultrasonic wave irradiation is marked as "x".

As shown in Table 3, in Comparative Example 1-5, the generation amount of powder is 1.8 g with respect to 10 g of the metal lump 107, whereas in Examples 1-1 to 1-4, the total amount (10 g) of the metal lump 107 is processed and the determination is "○". The average particle diameters of the powder in Examples 1-1 to 1-4 are 4 m to 5 μm, which are smaller than that in Comparative Example 1-5. Therefore, it can be seen that the pulverization processing is performed more efficiently in Examples 1-1 to 1-4.

Meanwhile, in Comparative Examples 1-1 to 1-3, not the total amount of the metal lump 107 is processed. In particular, in Comparative Examples 1-1 and 1-3, the generation amount is lower than that in Comparative Example 1-5.

In addition, in the case of Comparative Example 1-4, during the ultrasonic processing, solidification of the metal lump 107 occurs due to decrease in the temperature T2 of the first solvent 205, which reduces a processing amount of the metal lump 107 remarkably. It is considered that this is because the amount of heat from the first heating unit 207 is smaller than the amount of heat emitted from the first solvent 205 to the second solvent 211 via the propagation unit 310, and the temperature T2 of the first solvent 205 cannot be maintained at the desired temperature T2*d* (230° C.) or higher.

As described above, by providing the propagation unit 310, which propagates the ultrasonic wave, between the second solvent 211 in the propagation tank 304 and the first solvent 205 in the first tank 202, and by setting the thickness L to a value satisfying Expressions (2) and (3) described above, the ultrasonic processing can be performed efficiently at a high temperature of 200° C. or higher.

Example 2

In Example 2, the result was evaluated while changing the thickness L of the propagation unit 310, with a value of the thickness (111 mm, equal to the half wavelength λ/2) of the propagation unit 310 in Example 1-1 as a central value. Conditions in Example 2 other than the thickness L of the propagation unit 310 are the same as those in the Example 1 described above. Table 4 below shows Examples 2-1 to 2-5, Comparative Examples 2-1 and 2-2 in which the thickness L is not n/2 times the wavelength λ, and Comparative Example 1-5 (the same as Comparative Example 1-5 of Example 1) corresponding to the metal particle production device 200 in the related art.

TABLE 4

| | Thickness L (mm) | Heat conductivity (W/m · ° C.) | Area of bottom surface ($m^2$) | T2 − T1 (° C.) | Heat amount Q (W) |
|---|---|---|---|---|---|
| Example 2-1 | 100 | 1.5 | 0.018 | 210 | 500 |
| Example 2-2 | 105 | 1.5 | 0.018 | 210 | 500 |
| Example 2-3 (Example 1-1) | 111 | 1.5 | 0.018 | 210 | 500 |
| Example 2-4 | 116 | 1.5 | 0.018 | 210 | 500 |
| Example 2-5 | 122 | 1.5 | 0.018 | 210 | 500 |
| Comparative Example 2-1 | 94 | 1.5 | 0.018 | 210 | 500 |
| Comparative Example 2-2 | 127 | 1.5 | 0.018 | 210 | 500 |
| Comparative Example 1-5 | — | 1.5 | 0.018 | 210 | 500 |

| | L/λ | kS (T2 − T1)/Q (mm) | Generation amount (g) | Average particle diameter (μm) | Determination |
|---|---|---|---|---|---|
| Example 2-1 | 0.45 | 6.21 | 10 | 8 | ○ |
| Example 2-2 | 0.475 | 6.21 | 10 | 6 | ○ |
| Example 2-3 (Example 1-1) | 0.5 | 6.21 | 10 | 4 | ○ |
| Example 2-4 | 0.525 | 6.21 | 10 | 6 | ○ |

TABLE 4-continued

| | | | | | |
|---|---|---|---|---|---|
| Example 2-5 | 0.55 | 6.21 | 10 | 9 | ○ |
| Comparative Example 2-1 | 0.425 | 6.21 | 4.8 | 15 | Δ |
| Comparative Example 2-2 | 0.575 | 6.21 | 4.5 | 12 | Δ |
| Comparative Example 1-5 | — | — | 1.8 | 17 | — |

The thickness L in Examples 2-1 to 2-5 is set to be a value±5% or ±10% with 111 mm as a central value (Example 2-3). More specifically, the thickness L is −10% (100 mm) in Example 2-1, is −5% (105 mm) in Example 2-2, is +5% (116 mm) in Example 2-4, and is +10% (122 mm) in Example 2-5. As shown in Table 4, in Examples 2-1 to 2-5, the total amount of the metal lump 107 is processed, and the determination is "○". In addition, in Examples 2-1 to 2-5, the average particle diameters of powder are smaller than that in Comparative Example 1-5. Further, the average particle diameter decreases as the thickness L of the propagation unit 310 gets closer to 111 mm that is equal to the half wavelength, and the average particle diameter increases as an error (getting away from 111 mm) gets larger.

Meanwhile, in Comparative Examples 2-1 and 2-2, cases where the thickness L of the propagation unit 310 is set to be values more than ±10% away from 111 mm are shown. In Comparative Examples 2-1 and 2-2, not the total amount of the metal lump 107 is processed, and the processing amount decreases remarkably as the value of the thickness L gets away from 111 mm.

Thus, it can be seen that the ultrasonic processing is performed more efficiently as the thickness L of the propagation unit 310 gets closer to an integral multiple of the half wavelength λ/2 (one time of λ/2 in Example 2).

Example 3

In Example 3, the result was evaluated while changing the thickness L of the propagation unit 310, with the thickness (221 mm, the same as the wavelength λ) of the propagation unit 310 in Example 1-2 as a central value. Conditions in Example 3 other than the thickness L of the propagation unit 310 are the same as those in Example 1 described above. Table 5 below shows Examples 3-1 to 3-5, Comparative Examples 3-1 and 3-2 in which the thickness L is not an integral multiple of the half wavelength λ/2, and Comparative Example 1-5 (the same as Comparative Example 1-5 of Example 1) corresponding to the metal particle production device 200 in the related art.

TABLE 5

| | Thickness L (mm) | Heat conductivity (W/m · ° C.) | Area of bottom surface ($m^2$) | T2 − T1 (° C.) | Heat amount Q (W) |
|---|---|---|---|---|---|
| Example 3-1 | 210 | 1.5 | 0.018 | 210 | 500 |
| Example 3-2 | 216 | 1.5 | 0.018 | 210 | 500 |
| Example 3-3 (Example 1-2) | 221 | 1.5 | 0.018 | 210 | 500 |
| Example 3-4 | 227 | 1.5 | 0.018 | 210 | 500 |
| Example 3-5 | 232 | 1.5 | 0.018 | 210 | 500 |
| Comparative Example 3-1 | 205 | 1.5 | 0.018 | 210 | 500 |
| Comparative Example 3-2 | 238 | 1.5 | 0.018 | 210 | 500 |
| Comparative Example 1-5 | — | 1.5 | 0.018 | 210 | 500 |

| | L/λ | kS (T2 − T1)/Q (mm) | Generation amount (g) | Average particle diameter (μm) | Determination |
|---|---|---|---|---|---|
| Example 3-1 | 0.95 | 6.21 | 10 | 9 | ○ |
| Example 3-2 | 0.975 | 6.21 | 10 | 6 | ○ |
| Example 3-3 (Example 1-2) | 1.0 | 6.21 | 10 | 5 | ○ |
| Example 3-4 | 1.025 | 6.21 | 10 | 6 | ○ |
| Example 3-5 | 1.05 | 6.21 | 10 | 8 | ○ |
| Comparative Example 3-1 | 0.925 | 6.21 | 4.3 | 16 | Δ |
| Comparative Example 3-2 | 1.075 | 6.21 | 4.0 | 14 | Δ |
| Comparative Example 1-5 | — | — | 1.8 | 17 | — |

The thickness L of the propagation unit 310 in Examples 3-1 to 3-5 is set to be a value±5% or ±10% with 221 mm as a central value (Example 3-3). More specifically, the thickness L is −10% (210 mm) in Example 3-1, is −5% (216 mm) in Example 3-2, is +5% (227 mm) in Example 3-4, and is +10% (232 mm) in Example 3-5. As shown in Table 5, in Examples 3-1 to 3-5, the total amount of the metal lump 107 is processed, and the determination is "○". In Examples 3-1 to 3-5, the average particle diameters of the powder are smaller than that in Comparative Example 1-5. Further, the average particle diameter decreases as the thickness L of the propagation unit 310 gets closer to 221 mm that is equal to the wavelength λ, and the average particle diameter increases as an error (getting away from 221 mm) gets larger.

Meanwhile, in Comparative Examples 3-1 and 3-2, cases where the thickness L of the propagation unit 310 is set to be a value more than ±10% away from 221 mm are shown. In Comparative Examples 3-1 and 3-2, not the total amount of the metal lump 107 is processed, and the processing amount decreases remarkably as the value of the thickness L gets away from 221 mm.

Thus, it can be seen that the ultrasonic processing is performed more efficiently as the thickness L of the propagation unit 310 gets closer to an integral multiple of the half wavelength λ/2 (two times of λ/2 in Example 3).

Example 4

In Examples 1 to 3, quartz glass was used for the propagation unit 310, while in Example 4, the result was evaluated after the material of the propagation unit 310 was changed to SUS304. The sound speed of SUS304 at 115° C. is 5780 m/s, approximately equivalent to that of quartz glass. Meanwhile, the heat conductivity of SUS304 is 16 W/m·° C., which is larger than that of quartz glass.

Table 6 below shows Examples 4-1 to 4-4 in which SUS304 is used for the propagation unit 310 and the respective thickness L is changed, Comparative Examples 4-1 to 4-3 in which the thickness L is not an integral multiple of the half wavelength λ/2, and Comparative Example 4-4 corresponding to the metal particle production device 200 in the related art. Comparative Example 4-4 corresponding to the metal particle production device 200 in the related art corresponds to a case where the material of the first tank 202 and the third heating tank 306 is set to be SUS304 based on the configuration (see FIG. 18) of Comparative Example 1-5 of Example 1 described above.

The thickness L of the propagation unit 310 in Examples 4-1 to 4-4 is set to be about one time, two times, three times, or four times the half wavelength 111 mm respectively. As shown in Table 6, in Examples 4-1 to 4-4, the total amount of the metal lump 107 is processed, and the determination is "○".

Meanwhile, in Comparative Examples 4-1 to 4-3, examples in which the thickness L is set to be a value away from an integral multiple of the half wavelength λ/2 are shown. In Comparative Examples 4-1 to 4-3, not the total amount of the metal lump 107 is processed. In particular, in Comparative Examples 4-1 and 4-3, the generation amounts are lower than that in Comparative Example 4-4.

In addition, in Comparative Example 4-1, during the ultrasonic processing, solidification of the metal lump 107 occurs due to decrease in the temperature T2 of the first solvent 205, which reduces the processing amount of the metal lump 107 remarkably. It is considered that this is because the heat conductivity of SUS304 is 16 W/m·° C., higher than that of quartz glass, the amount of heat from the first heating unit 207 is smaller than the amount of heat emitted from the first solvent 205 to the second solvent 211 via the propagation unit 310, and the temperature T2 of the first solvent 205 cannot be maintained at the desired temperature T2*d* (230° C.) or higher.

When the results of Examples 4-1 to 4-4 are compared with the results of Examples 1-1 to 1-4 in which the material of the propagation unit 310 is quartz glass, the generation amounts of the powder are equal or larger and the average particle diameters are smaller in Examples 1-1 to 1-4, regardless of the thickness L of the propagation unit 310. That is, it is seen that the ultrasonic processing is performed more efficiently by using quartz glass than SUS304 for the propagation unit 310.

The reason why the ultrasonic processing is performed more efficiently by using quartz glass than SUS304 for the

TABLE 6

| | Thickness L (mm) | Heat conductivity (W/m · ° C.) | Area of bottom surface ($m^2$) | T2 − T1 (° C.) | Heat amount Q (W) |
|---|---|---|---|---|---|
| Example 4-1 | 111 | 16 | 0.018 | 210 | 500 |
| Example 4-2 | 221 | 16 | 0.018 | 210 | 500 |
| Example 4-3 | 332 | 16 | 0.018 | 210 | 500 |
| Example 4-4 | 442 | 16 | 0.018 | 210 | 500 |
| Comparative Example 4-1 | 55 | 16 | 0.018 | 210 | 500 |
| Comparative Example 4-2 | 83 | 16 | 0.018 | 210 | 500 |
| Comparative Example 4-3 | 166 | 16 | 0.018 | 210 | 500 |
| Comparative Example 4-4 | — | — | 0.018 | 210 | 500 |

| | L/λ | kS (T2 − T1)/Q (mm) | Generation amount (g) | Average particle diameter (μm) | Determination |
|---|---|---|---|---|---|
| Example 4-1 | 0.6 | 66.2 | 10 | 7 | ○ |
| Example 4-2 | 1.0 | 66.2 | 10 | 7 | ○ |
| Example 4-3 | 1.5 | 66.2 | 10 | 9 | ○ |
| Example 4-4 | 2.0 | 66.2 | 10 | 8 | ○ |
| Comparative Example 4-1 | 0.25 | 66.2 | 0.3 | 38 | x |
| Comparative Example 4-2 | 0.375 | 66.2 | 3.2 | 27 | Δ |
| Comparative Example 4-3 | 0.75 | 66.2 | 1.0 | 18 | x |
| Comparative Example 4-4 | — | — | 1.4 | 21 | — |

propagation unit 310 is considered to be as follows. When linear expansion coefficients of quartz glass and SUS304 are compared, the linear expansion coefficient of SUS 304 is 17 ppm/K, larger than 0.55 ppm/K of quartz glass. Therefore, SUS304 has a larger size change due to heat. Therefore, it is considered that, in the case of SUS304, the thickness L of the propagation unit 310 tends to be a value away from the set thickness due to the heat transferred from the first solvent 205 of a high temperature (230° C. or higher)

<Functions and Effects>

As described above, the metal particle production device of the disclosure is the metal particle production device 400 that processes the metal lump 107 in the first solvent 205 by using an ultrasonic wave. The metal particle production device 400 includes: the first ultrasonic vibrator 209 that emits the ultrasonic wave; the first tank 202 that accommodates the metal lump 107 in a state of being immersed in the first solvent 205; and the propagation unit 310 that is provided disposed between the first ultrasonic vibrator 209 and the first tank 202 to contact the first tank 202, and has the incidence surface 310S1 on which the ultrasonic wave is incident and the radiation surface 310S2 through which the ultrasonic wave incident via the second solvent 211 interposed between the first ultrasonic vibrator 209 and the incidence surface 310S1 is radiated on the first tank 202 side.

With such a configuration, even when the ultrasonic processing in a high temperature environment is required, the heat of the first solvent 205 of a high temperature is transferred directly via the propagation unit 310 without being transferred to the first ultrasonic vibrator 209. Therefore, the influence of the heat of the first solvent 205 on the ultrasonic vibrator can be prevented.

In addition, in the metal particle production device of the disclosure, the incidence surface 310S1 and the radiation surface 310S2 face each other in the propagation unit 310. The distance L from the incidence surface 310S1 to the radiation surface 310S2 (the thickness of the propagation unit 310) satisfies the following Expressions (2) and (3). Expressions (2) and (3) here are the same as Expressions (2) and (3) described above.

$$0.95\times n\lambda/2 \leq L \leq 1.05\times n\lambda/2 \quad (2)$$

$$L \geq [kS(T2-T1)]/Q \quad (3)$$

λ represents the wavelength of the ultrasonic wavelength, k represents the heat conductivity of the propagation unit 310, S represents the area of the radiation surface 310S2, T2 represents the temperature of the first solvent 205, T1 represents the temperature of the second solvent 211, and n represents a positive integer.

With such a configuration, the ultrasonic wave that is incident into the propagation unit 310 is amplified by resonance, and a decrease in strength at the boundary surface can be prevented. In addition, the influence of heat on the first ultrasonic vibrator 209 can be prevented while the first solvent 205 in which the metal lump 107 is immersed is maintained at a high temperature (200° C. or higher). Accordingly, the processing target can be heated to a high temperature while the ultrasonic vibrator can be cooled and protected, and the ultrasonic processing can be performed efficiently.

Therefore, according to the metal particle production device of the disclosure, since the ultrasonic processing can be performed efficiently at a high temperature for a large area, it is possible to perform cleaning, miniaturization, and the like on various substances. In particular, the metal particle production device of the disclosure can be applied to production of fine metal powder and the like.

<Modification>

Various embodiments have been described above with reference to the drawings, but the disclosure is not limited to these embodiments. It will be apparent to those skilled in the art that various changes and modifications can be conceived within the scope of the claims, and it is understood that such changes and modifications belong to the technical scope of the disclosure. Constituent elements in the embodiments described above may be arbitrarily combined within a range not departing from the spirit of the disclosure.

In the embodiment described above, it is exemplified that the second solvent 211 is water and the first solvent 205 is silicone oil, but the disclosure is not limited thereto. Other liquids may be used as the second solvent 211 and the first solvent 205. In the embodiment described above, a case where quartz glass or SUS304 is used for the propagation unit 310 is described, but the disclosure is not limited thereto and other materials may be used.

In the embodiment described above, the cooler 311 and the first heating unit 207 are controlled by the control unit 320, but the disclosure is not limited thereto. The cooler 311 and the first heating unit 207 may be controlled by different control units. Alternatively, for example, the matching box 312 that controls the first ultrasonic vibrator 209, and the control unit 320 that controls the cooler 311 and the first heating unit 207 may be integrated.

Fifth Embodiment

Hereinafter, a fifth embodiment of the disclosure will be described in detail.

<Metal Particle Production Device>

Figure 19:
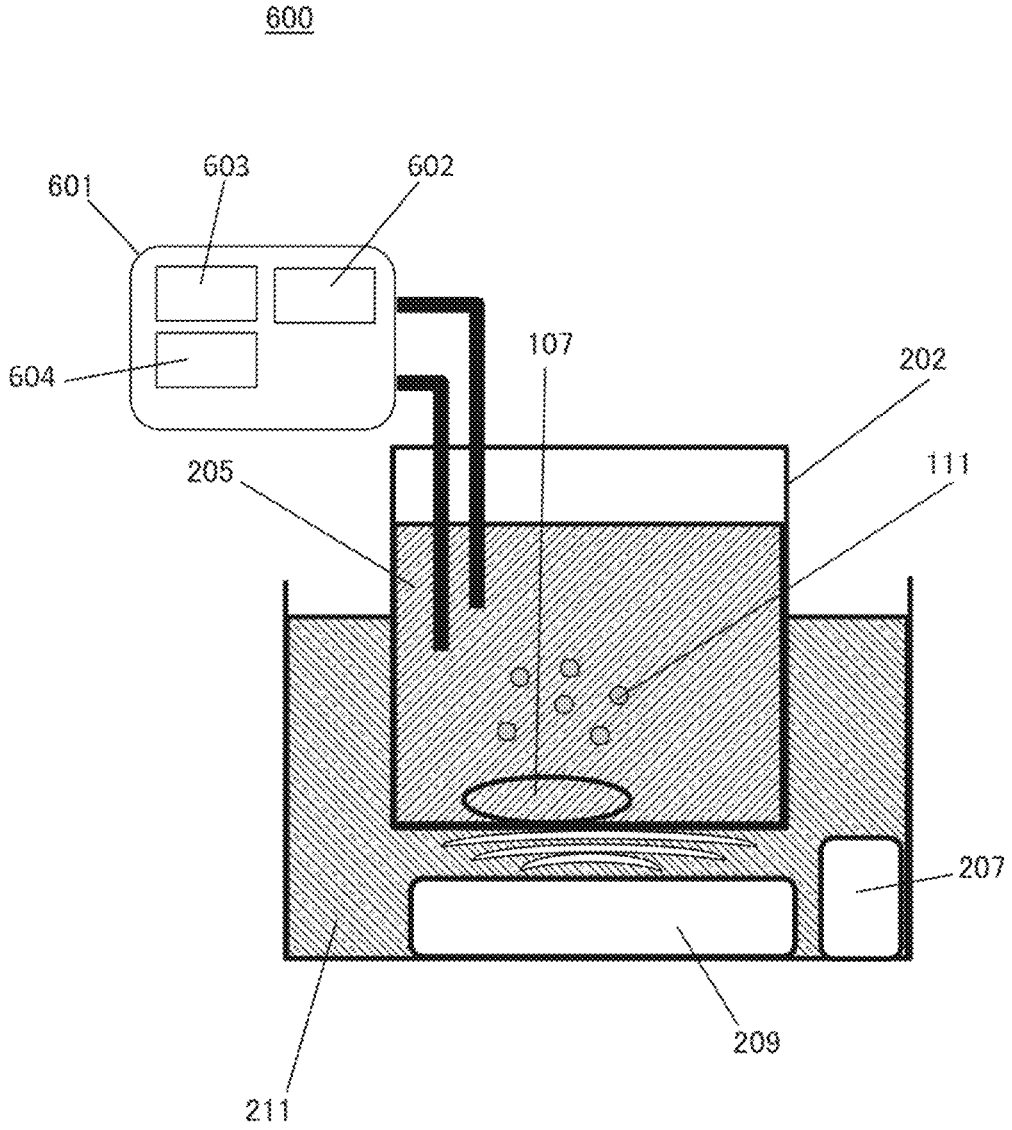
FIG. 19 is a cross-sectional view of a metal particle production device according to a fifth embodiment.

FIG. 19 is a diagram illustrating a configuration of a metal particle production device 600 according to a fifth embodiment. As shown in FIG. 19, the metal particle production device 600 includes the first tank 202, the second tank 204, the first ultrasonic vibrator 209, a dissolved gas concentration adjustment device 601, and the first heating unit 207. The first solvent 205 is accommodated in the first tank 202. The first tank 202 is disposed in the second tank 204, and the second solvent 211 is accommodated around the first tank 202. The first ultrasonic vibrator 209 is disposed on an outer side of the first tank 202 and on an inner side of the second tank 204, and is covered with the second solvent 211. The dissolved gas concentration adjustment device 601 measures a dissolved gas concentration in the first solvent 205 and adjusts the dissolved gas concentration in the first solvent 205.

As the first solvent 205, a liquid, which has a boiling point higher than the melting point of the metal lump 107 and which is thermally stable, is used (in other words, a liquid that does not decompose or is difficult to decompose during heating for melting the metal lump 107). The boiling point of the first solvent 205 is preferably 100° C. higher, and more preferably 130° C. higher than the melting point of the metal lump 107. The boiling point mentioned in the description is a boiling point under normal pressure.

Unlike the first solvent 205, the second solvent 211 is not particularly limited. The boiling point of the second solvent 211 may be lower than that of the first solvent 205. The boiling point of the second solvent 211 may be lower than the melting point of the metal lump 107 as long as the second solvent 211 can be maintained at or below the boiling point thereof during the production of the primary particles 111. Therefore, various liquids can be adopted as the second solvent 211. Examples of the second solvent 211 include water (boiling point: 100° C.), ethanol (boiling point: 78° C.), and isopropyl alcohol (boiling point: 83° C.). As the second solvent 211, a medium different from the first solvent 205 may be used, or a medium same as the first solvent 205 may be used.

The first solvent 205 and the second solvent 211 are placed in the first tank 202 and the second tank 204 respectively. In the second tank 204, the first ultrasonic vibrator 209 is disposed such that an ultrasonic vibration surface thereof is covered with the second solvent 211.

The thickness and material of the first tank 202 are selected such that an ultrasonic wave emitted from the first ultrasonic vibrator 209 can be efficiently propagated from the second solvent 211 to the first solvent 205. The thickness of the first tank 202 is, for example, 1.0 mm or less, more preferably 0.3 mm or more and 0.5 mm or less. The material of the first tank 202 is, for example, heat-resistant glass and ceramic. The thickness and material of the second tank 204 are not particularly limited, and any appropriate thickness and material may be adopted.

<Process>

The prepared metal lump 107 is immersed in the first solvent 205 in the first tank 202 as shown in FIG. 19.

Next, the first solvent 205 is heated by the heating unit 207 to a temperature equal to or higher than the melting point of the metal lump 107. Accordingly, the metal lump 107 is melted in the first solvent 205.

A method of heating by the first heating unit 207 is not particularly limited. For example, heating using microwaves may be used, or heating using a halogen heater, a throw-in heater or hot air may be used.

Immersion of the metal lump 107 into the first solvent 205 and heating of the first solvent 205 are not necessarily performed in this order, and may be performed at any appropriate timing. For example, the first solvent 205 may be preheated to a temperature equal to or higher than the melting point of the metal lump 107, and then the metal lump 107 may be immersed therein.

By heating the first solvent 205, the metal lump 107 is melted. After the metal lump 107 is at least partially melted, preferably entirely melted, the first ultrasonic vibrator 209 immersed in the second solvent 211 operates. The first ultrasonic vibrator 209 receives a high frequency power from an ultrasonic oscillator (not shown), and vibrates to generate an ultrasonic wave. In the fifth embodiment, any ultrasonic vibrator can be used as the first ultrasonic vibrator 209. As the first ultrasonic vibrator 209, a commercially available first ultrasonic vibrator 209 can be used, such as a throw-in type or a flange type.

The ultrasonic wave generated by the vibration of the first ultrasonic vibrator 209 is propagated, via the second solvent 211 and a partition wall of the first tank 202, to the first solvent 205. Accordingly, the cavitation occurs in the first solvent 205. When a shock wave generated by the cavitation, more specifically, impact pressure at the moment when air bubbles broke, acts on the surface of the molten metal material, droplets of an infinite number of fine primary particles 111 are generated.

The frequency of the first ultrasonic vibrator 209 is, for example, 0.5 kHz or more and 2000 kHz or less, and preferably 20 kHz or more and 100 kHz or less. The frequency of the first ultrasonic vibrator 209 can be selected in such a range based on a desired particle diameter, production efficiency, and the like.

<Control Over Dissolved Gas Concentration in First Solvent 205>

In other words, during the operation of the first ultrasonic vibrator 209, the dissolved gas concentration adjustment device 601 performs dissolved gas concentration adjustment such that the dissolved gas concentration in the first solvent 205 is in a predetermined concentration range.

The dissolved gas concentration adjustment device 601 includes, for example, a dissolved gas sensor 602, a deaeration device 603, and a gas dissolving device 604. The dissolved gas concentration adjustment device 601 uses the dissolved gas sensor 602 to measure the dissolved gas concentration in the first solvent 205, and uses the deaeration device 603 to reduce the dissolved gas concentration when a measurement result indicates that the dissolved gas concentration is outside the predetermined concentration range. Alternatively, the gas dissolving device 604 is used to increase the dissolved gas concentration.

Here, a dissolved gas is, for example, oxygen. In this case, a dissolved oxygen removal device is used as the deaeration device 603 to remove oxygen. The gas dissolving device 604 blows oxygen into the solvent 205.

The predetermined range of the dissolved gas concentration will be described in detail in the following example. When butyl triglycol (BTG: having a boiling point of 271° C. and a viscosity of 8.1 mPa·s) is used for the first solvent 205 and Sn-58 mass % Bi (having a melting point of 138° C. and a specific gravity of 8.76 g/cm$^3$) is used for the metal lump 107, the dissolved gas concentration is, for example, 1.5 mg/L or more and 4.5 mg/L or less. It is empirically known that the generation amount of the primary particles 111 is larger than a predetermined amount within this concentration range using the metal particle production device 600 according to the fifth embodiment. A basis for the numerical values of this concentration range is as follows.

In general, the dissolved gas concentration in the first solvent 205 is about 5 mg/L or more. The term "in general" used herein means a case where the dissolved gas concentration in the first solvent 205 does not change. That is, the dissolved gas concentration in the first solvent 205 before the ultrasonic wave irradiation is about 5 mg/L.

When the dissolved gas concentration in the first solvent 205 is 5 mg/L or more, a large number of air bubbles are present in the first solvent 205. When the first solvent 205 is irradiated with the ultrasonic wave in such a state, the propagation of the ultrasonic wave is inhibited by the air bubbles. Therefore, the impact pressure caused by the generated shock wave is lower as compared with a case where the dissolved gas concentration is within the predetermined range (1.5 mg/L or more and 4.5 mg/L or less). When the impact pressure generated by the cavitation is lowered, the generation efficiency of the primary particles 111 from the molten metal lump 107 is also lowered. Here, in the metal particle production device 600 according to the fifth embodiment, it can be seen that there is a roughly proportional relationship between the impact pressure due to the cavitation and the generation amount of the primary particles 111. Therefore, when the dissolved gas concentration in the first solvent 205 is 5 mg/L or more, the production efficiency of the primary particles 111 is lower as compared with the case where the dissolved gas concentration is within the predetermined range (1.5 mg/L or more and 4.5 mg/L or less).

Since the air bubbles collapse due to the shock wave when the first solvent 205 is continued to be irradiated with the ultrasonic wave, the dissolved gas concentration in the first solvent 205 gradually decreases. Accordingly, the production efficiency of the primary particles 111 gradually increases if the first solvent 205 is continued to be irradiated with the ultrasonic wave. However, since it is more preferable to efficiently produce the primary particles 111 immediately after the ultrasonic wave irradiation, the dissolved gas concentration adjustment device 601 performs deaeration processing such that the dissolved gas concentration in the first solvent 205 is 4.5 mg/L or less before the start of ultrasonic wave irradiation. Accordingly, the primary particles 111 can be efficiently produced immediately after the start of the ultrasonic wave irradiation.

Further, as described above, since the dissolved gas concentration in the liquid is lowered due to the ultrasonic wave irradiation, the dissolved gas concentration in the first solvent 205 decreases as the ultrasonic processing continues. Since the dissolved gas contributing to the occurrence of the cavitation is too little when the lowered dissolved gas concentration in the first solvent 205 is less than about 1.5 mg/L, the impact pressure due to the cavitation is not properly generated, and the generation amount of the primary particles 111 decreases. Therefore, the dissolved gas concentration adjustment device 601 performs gas dissolution processing such that the dissolved gas concentration in the first solvent 205 is 1.5 mg/L or more during the ultrasonic wave irradiation.

Figure 20:
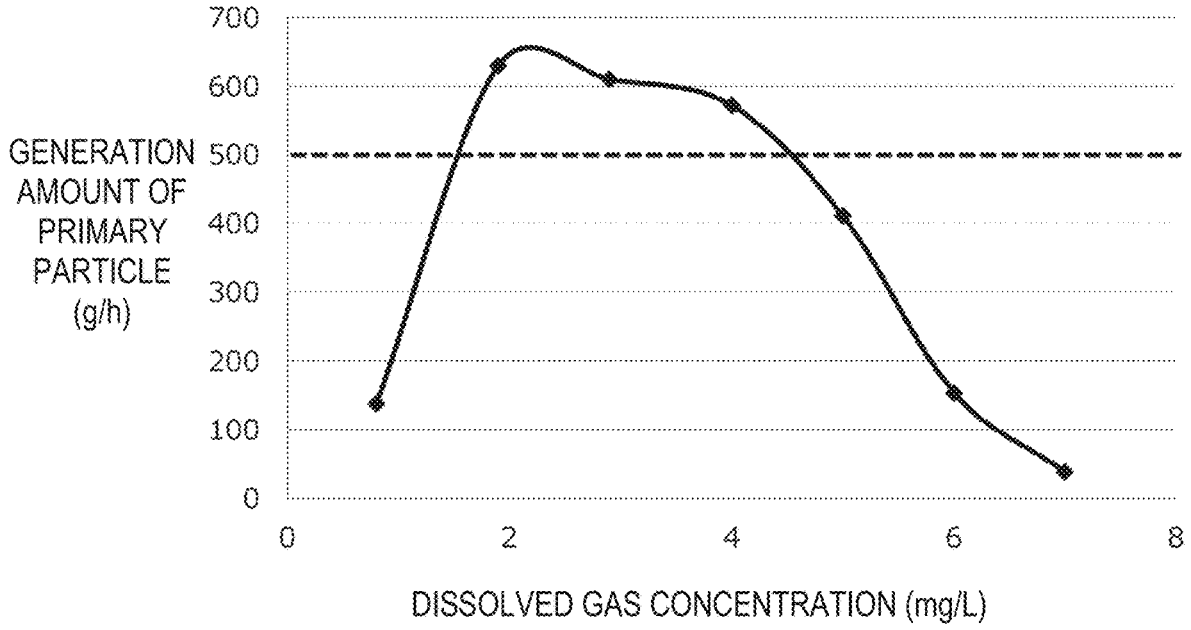
FIG. 20 is a diagram illustrating a relationship between a dissolved gas concentration and a generation amount of primary particles in the metal particle production device according to the fifth embodiment.

FIG. 20 is a diagram illustrating a relationship between the dissolved gas concentration and the generation amount of the primary particles 111 in the metal particle production device 600 according to the fifth embodiment. FIG. 20 illustrates an example in which butyl triglycol (BTG: having a boiling point of 271° C. and a viscosity of 8.1 mPa·s) is used for the first solvent 205 and Sn-58 mass % Bi (having a melting point of 138° C. and a specific gravity of 8.76 g/cm$^3$) is used for the metal lump 107. As shown in FIG. 20, it can be seen that when the dissolved gas concentration of the first solvent 205 is 1.5 mg/L or more and 4.5 mg/L or less, the generation amount per hour exceeds 500 g/h. The relationship between the dissolved gas concentration and the generation amount of the primary particles 111 shown in FIG. 20 is an example, and the range of the dissolved gas concentration in which the metal particles can be efficiently produced is also changed if the liquid medium is changed.

<Formation of Metal Particle>

As described above, the shock wave generated due to the ultrasonic cavitation in step S4 acts on the surface of the molten metal lump 107, so that the spherical primary particles 111 are formed separately in the form of droplets from the molten metal material (liquid lump) 107. The droplets of the formed primary particles 111 are spherical due to their own surface tension in the first solvent 205. Accordingly, the primary particles 111 having a small particle diameter and a spherical shape are produced. Specifically, the primary particles 111 have a particle diameter of, for example, 10 μm or less, preferably 6 μm or less, typically 1 μm or more and 10 μm or less, and more typically 1 μm or more and 6 μm or less.

As described above, in the metal particle production device 600 according to the fifth embodiment, the dissolved gas concentration adjustment device 601 adjusts the dissolved gas concentration in the first solvent 205 to be within the predetermined range, so that the spherical primary particles 111 having a small particle diameter, for example, a particle diameter of 10 μm or less, can be efficiently produced.

If the dissolved gas concentration adjustment device 601 is attached to each tank in the first to fourth embodiments and controlled, particles can be generated more efficiently in each embodiment.

OVERALL

The embodiments can be combined. For example, the heating tank in the fourth embodiment can be used as the heating tank in the first and second embodiments respectively.

This disclosure is useful for a metal particle production method and device for producing various metal particles using a liquid phase method.

What is claimed is:

1. A metal microparticle production device, comprising:
- a first tank configured to contain a solvent and a metal lump;
- a first heating unit that heats the solvent in the first tank;
- a first ultrasonic vibrator that is disposed in the first tank and irradiates the metal lump with a first ultrasonic wave to generate primary particles;
- a second tank configured to contain the solvent and the primary particles;
- a second ultrasonic vibrator that irradiates the primary particles with an ultrasonic wave to split the primary particles; and
- a partition between the first tank and the second tank, wherein the primary particles and the solvent flow from the first tank to the second tank over the partition.

2. The metal microparticle production device according to claim 1, further comprising a plurality of temperature measurement units for measuring temperatures of a second heating unit, a cooling device, and the solvent disposed in the second tank.

3. A metal microparticle production device, comprising:
- a first tank configured to contain a solvent and a metal lump;
- a first heating unit that heats the solvent in the first tank;
- a first ultrasonic vibrator that is disposed in the first tank and irradiates the metal lump with a first ultrasonic wave to generate primary particles;
- a second tank configured to contain the solvent and the primary particles; and
- a second ultrasonic vibrator that irradiates the primary particles with an ultrasonic wave to split the primary particles wherein in the second tank, a second ultrasonic vibration generating element is provided at a portion connected to the first tank, a second heating unit is positioned on one side surface of the second ultrasonic vibration generating element, and a cooling device is provided on the other side surfaces thereof.

4. The metal microparticle production device according to claim 3, wherein the second heating unit, the second ultrasonic vibration generating element, and the cooling device are arranged in a row in this order, a pump is disposed behind the cooling device, and the pump transmits the solvent to the second heating unit.

5. A metal microparticle production device, comprising:
- a first tank configured to contain a solvent and a metal lump;
- a first ultrasonic vibrator that is disposed in the first tank and irradiates the metal lump with an ultrasonic wave to generate primary particles;
- a second tank that has the solvent and the primary particles; and
- a second ultrasonic vibrator that is disposed in the second tank, irradiates the primary particles with an ultrasonic wave, and aggregates the primary particles to generate tertiary particles larger than the primary particles.

6. The metal microparticle production device according to claim 5, wherein the second tank includes a magnet that applies a magnetic field to a flow of a solvent containing the primary particles and the tertiary particles to thereby classify the primary particles and the tertiary particles.

7. The metal microparticle production device according to claim 5, further comprising a dissolved gas concentration adjustment device that adjusts a dissolved gas concentration of the solvent disposed in the first tank or the second tank.

* * * * *